US008786511B1

(12) United States Patent
Dao

(10) Patent No.: US 8,786,511 B1
(45) Date of Patent: Jul. 22, 2014

(54) IMPACT RESISTANT UHF SATCOM ANTENNAS

(75) Inventor: Thach Kim Dao, Fountain Valley, CA (US)

(73) Assignee: MVOS Labs, Inc., Irvine, CA (US)

( * ) Notice: Subject to any disclaimer, the term of this patent is extended or adjusted under 35 U.S.C. 154(b) by 316 days.

(21) Appl. No.: 13/343,859

(22) Filed: Jan. 5, 2012

(51) Int. Cl.
*H01Q 9/26* (2006.01)

(52) U.S. Cl.
USPC ..... 343/803; 343/793; 343/797; 343/799

(58) Field of Classification Search
USPC ..... 343/793, 795, 797, 799, 803
See application file for complete search history.

(56) References Cited

U.S. PATENT DOCUMENTS 3,363,255 A * 1/1968 Nienaber ..... 343/795
7,199,763 B2 * 4/2007 Bryan et al. ..... 343/709
8,055,209 B1 * 11/2011 Dao ..... 455/78
8,259,020 B1 * 9/2012 Macy et al. ..... 343/766
2012/0081259 A1 * 4/2012 Regala ..... 343/797

* cited by examiner

*Primary Examiner* — Tho G Phan
(74) *Attorney, Agent, or Firm* — William L. Chapin

(57) ABSTRACT

Antennas for transmitting and receiving circularly polarized UHF SATCOM radio signals include a mast which has four circumferentially spaced apart element mounts that protrude radially from the mast, each having a mechanical coupling mechanism holding an electrically conductive tubular antenna element disposed radially from the mast for use and parallel to the mast to minimize the envelope size of the antenna when not in use. Replaceable elements in one version of the antenna have a threaded stud threadably receivable in a threaded socket on the element mount. Each element of a foldable version of the antenna has a tapered support peg which is insertably receivable in a tapered socket in a boss on the element mount and releasably held therewithin by a tensioning spring within the element. Optionally, a fifth conductive element is disposed longitudinally within the mast to transmit and receive linearly polarized radio signals.

10 Claims, 22 Drawing Sheets

50
HIGH ANGLE ELEMENT
LOW ANGLE ELEMENT 137
64-4
64-2
64-1
64-3
132
131
139
141
140
145
144
135-2
135-3
135-1
135
136
136-1
N CONNECTOR
HIGH ANGLE
COAX
HYBRID
RESISTOR
50 OHMS
L 1
150 nH
L 2
150 nH
L 3
10 nH
L 4
12 nH
C 1
1.2 pF
C 2
12 pF
L 5
63 nH
COAX
TNC CONNECTOR
LOW ANGLE
142
143
A
B
C
D 64-1
94-1
123,119,118,120
124
98
94-3
64-3
122
117
SECTION A-A 56
145
SECTION B-B 64-1
64-3
B
A
HI ANGLE ELEMENT ASSY.
COAXIAL ASSY. 131,132
144 COAXIAL INDUCTOR
SPACER PCB 122-B
122-B
56-B BASE PLATE ASSY.
N PORT 136
56 BASE HOUSING
143 TNC PORT

ELEMENT ASSEMBLY 196
198
199
197
237
200
211
194 ELEMENT MOUNT
164 ELEMENT ASSY.
171

202
204
198
196
198
203
205
196
211

164
ELEMENT CAP 171

196
171

196
198
236
211
233
164
171

SECTION VIEW: ELEMENT ASSEMBLY 194-1
194-3
164-1
233-1
122
233-3
164-3
SECTION A-A 156
145
SECTION B-B 164-3
164-1
B
A
HI ANGLE ELEMENT ASSY.
COAXIAL ASSY. 131,132
144 COAXIAL INDUCTOR
122-B SPACER PCB
BASE PLATE ASSY. 156-B
N PORT 236
BASE HOUSING 156
243 TNC PORT

IMPACT RESISTANT UHF SATCOM ANTENNAS

BACKGROUND OF THE INVENTION

A. Field of the Invention

The present invention relates to antennas to transmit and receive ultra-high frequency radio signals. More particularly, the invention relates to novel transportable X-WING type UHF SATCOM antennas which are attachable to a vehicle, ship or other support structure, and which are highly resistant to impact damage and readily repairable in the field.

B. Description of Background Art

Government agencies such as U.S. military services that utilize personnel operating in remote field locations have a need for instantaneous, reliable communication systems. Such systems are required for conveying data between personnel in field locations and fixed command and control sites. As a practical matter, communication systems which meet the various requirements for reliable communications of the type alluded to above generally utilize radio transceivers. Thus, the U.S. military services and other governmental agencies typically use for their communications between remote field location, and between remote field locations and command and control sites, small, readily transportable radio transceivers. Such transceivers, which are typically installed in vehicles or ships, usually operate at power levels of 200 watts or less. To achieve long distance communication capability, and to avoid line-of-sight signal transmission obstructions such as mountainous terrain, portable communication transceivers used for applications such as those described above often utilize a transponder located in an earth-orbiting satellite, and are hence used in communication systems referred to as Satellite Communication (SATCOM) systems.

Radio transceivers of the type described above must of course use an antenna to transmit and receive radio signals through space. Thus, transportable transceivers which are used to communicate over long distances and/or rugged terrain where line-of-sight communication is not feasible often utilize transmissions between an earth-orbiting satellite to provide the needed range and terrain obstruction avoidance. For such applications, small SATCOM antennas mountable to vehicles, ships or portable shelters and operable in ultra-high frequency (UHF) radio bands are frequently used.

Vehicle mountable SATCOM antennas currently in use are required to have a reasonably high gain in UHF radio bands located generally between about 225 MHZ and 400 MHZ. Typical SATCOM antennas are constructed to utilize circularly polarized signals. Circular polarization is required for satellite communication because ionized particles in the upper part of the atmosphere known as the ionosphere rotate the plane of polarization of a linearly polarized radio signal, thus causing a polarization mismatch in linearly polarized antennas. One type of SATCOM antenna in common use has a "turnstile" type external appearance, or "form factor," which includes a central straight, longitudinally disposed mast that has protruding radially outwards from the upper end of the mast four radiating elements which are spaced circumferentially apart at 90-degree intervals. The active part of each radiating element which is effective in transmitting or receiving radio frequency electromagnetic waves is an elongated straight electrical conductor, which may be in the form of a blade or rod. The conductors of one pair of diametrically opposed elements comprise an electric dipole antenna that is electrically connected to a first port of a hybrid antenna coupler network. The conductors of a second pair of elements oriented at 90-degrees to the first pair comprise a second electric dipole antenna, and are connected to a second port of the antenna coupler network, which is shifted in phase 90-degrees from the first port by circuitry in the coupler network. This arrangement results in the transmission of a circularly polarized signal. The arrangement also enables the conductors of the elements of the antenna to intercept and receive at relatively high gain radio signals of various polarizations, when the antenna is operated in a receive mode, with no transmitting signals applied to the radiating elements.

When viewed from above or below, the radiating elements of SATCOM antennas of the type described above, which typically consist of four conductive rods which extend perpendicularly outwards from the antenna mast, form an X-shaped pattern. Thus such antennas are commonly referred to as "X-WING" antennas.

Portable X-WING SATCOM antennas which are intended for use in field operations are typically mounted to the hood, roof or the fender of a vehicle, such as a HumVee. Therefore, the outwardly protruding radiating elements of such antennas are subject to impact damage from contact with low-hanging tree branches, for example. Such damage can degrade or completely destroy the functionality of X-WING antennas currently in use, and thus jeopardize the success of missions which require reliable communications implemented with the antenna. Accordingly, it would be desirable to provide an improved X-WING UHF SATCOM antenna which had superior impact resistance. For the same reason, it would be desirable to provide an improved impact resistant X-WING UHF SATCOM antenna which utilized field-replaceable radiating elements. Also, it would be desirable to provide an improved UHF SATCOM antenna which utilized radiating elements that could be readily replaced in the field if damaged.

An additional problem with prior art X-WING UHF SATCOM antennas is the large amount of container space which is required to store and ship such antennas to the field. As can be readily envisioned, the form factor of an X-WING antenna, which includes a longitudinally elongated cylindrical mast that has four straight rod-like radiating elements approximately equal in length to the length of the mast protruding radially outwards from the upper end of the mast, requires essentially a storage or shipping space having the shape of a rectangular block whose height is equal to the mast height, and whose base sides are equal to the length of the radiating elements. Accordingly, it would be desirable to provide an improved X-WING UHF SATCOM antenna which could be configured to a smaller space for shipping, and quickly and easily be re-configured to an operational configuration in the field.

The foregoing limitations of prior art X-WING UHF SATCOM antennas, and the foregoing improvement objectives, were motivating factors for the present invention.

OBJECTS OF THE INVENTION

An object of the present invention is to provide a portable X-WING type UHF SATCOM antenna which has protruding perpendicularly outwards from a mast radiating elements that are capable of withstanding substantially large impacts from objects without destroying the functionality of the antenna.

Another object of the invention is to provide an impact resistant X-WING type UHF SATCOM antenna which includes an elongated straight tubular mast that has protruding radially outwardly from the cylindrical wall surface of the mast near the upper transverse end wall of the mast radiating elements which are threadably and removably attached to the mast.

Another object of the invention is to provide a dual function X-WING UHF SATCOM antenna which has a hollow tubular mast that has disposed longitudinally therewithin an electrically conductive cylindrical tube which functions as a vertically polarized broadband monopole antenna, and cylindrical rod-shaped elements which protrude radially and perpendicularly outwards from the upper end of the mast tube and are spaced circumferentially apart at ninety degree intervals to function as a circularly polarized cross dipole antenna, the elements being threadably attached to the mast to enable field replaceability of the elements.

Another object of the invention is to provide an impact resistant X-WING UHF SATCOM antenna with foldable elements which has an elongated straight tubular mast that has protruding radially and perpendicularly outwards from the upper end of the mast straight cylindrically-shaped tubular conductive radiating elements which are pivotable downwardly to orientations parallel to the longitudinal axis of the mast for storage and shipment, and pivotable upwards to an operational orientation perpendicular to the mast, where a spring mechanism within each radiating element locks the element into a perpendicular operational orientation.

Another object of the invention is to provide a dual function impact resistant X-WING UHF SATCOM antenna with foldable radiating elements which has a hollow tubular mast made of an electrically non-conductive material such as fiberglass which has disposed longitudinally through the bore of the mast an elongated straight hollow electrically conductive cylinder which functions as a vertically polarized broadband monopole antenna, and which has protruding radially outwards from the upper end of the mast straight cylindrically-shaped tubular conductive radiating elements which are pivotable downwardly to orientations parallel to the longitudinal axis of the mast for storage and shipment, and pivotable upwards to an orientation perpendicular to the mast, where a spring mechanism within each radiating element locks the element into a perpendicular use orientation.

Various other objects and advantages of the present invention, and its most novel features, will become apparent to those skilled in the art by perusing the accompanying specification, drawings and claims.

It is to be understood that although the invention disclosed herein is fully capable of achieving the objects and providing the advantages described, the characteristics of the invention described herein are merely illustrative of the preferred embodiments. Accordingly, I do not intend that the scope of my exclusive rights and privileges in the invention be limited to details of the embodiments described. I do intend that equivalents, adaptations and modifications of the invention reasonably inferable from the description contained herein be included within the scope of the invention as defined by the appended claims.

SUMMARY OF THE INVENTION

Briefly stated, the present invention comprehends improved X-WING UHF SATCOM antennas which can withstand substantially powerful impacts without degrading the capability of the antennas to transmit and receive UHF radio signals.

A basic embodiment of an impact resistant X-WING UHF SATCOM antenna according to the present invention includes a thin, flat, hollow rectangular block-shaped mounting base which has a flat lower mounting surface for mounting the antenna to a support structure such as a hood, fender or roof of a vehicle, or to a structural component of a ship or shelter. The basic embodiment of an impact resistant X-WING UHF SATCOM antenna according to the present invention includes an elongated hollow circular cross-section cylindrically-shaped tubular mast which is mounted centrally to the upper surface of the mounting base and extends perpendicularly upwards therefrom. A circular cover cap fits over the upper entrance opening to a bore disposed longitudinally through the length of the mast. Four tubular radiating elements spaced circumferentially apart at ninety-degree intervals extend perpendicularly outward from the outer circumferential wall surface of the mast. The four elements are located near the upper end of the mast, with a transverse plane tangent to the upper surfaces of the elements approximately aligned with the upper transverse face of the mast cover cap.

According to the invention, each element includes an electrically conductive cylindrically shaped shell which has a cylindrical bore disposed through its length. The straight, electrically conductive shell of each radially disposed antenna element functions as the active component of each element, which is effective in transmitting and receiving electromagnetic waves at UHF radio frequencies. A first pair of diametrically opposed antenna elements comprises a first electric dipole antenna component. The second pair of diametrically opposed elements, spaced circumferentially apart at ninety degrees to the first pair of elements, functions as a second electric dipole antenna. As is known in the art, two such dipole antennas oriented perpendicularly to each other are effective in transmitting and receiving circularly polarized electromagnetic waves when driven by a radio frequency power source which feeds a sinusoidal signal of a first phase to one dipole element pair, and feeds a sinusoidal signal shifted in time phase by ninety degrees from the first signal to the second dipole pair. The required phase shifting is preferably accomplished by an electrical network known as a 3-db quarter wove coupler or 90-degree power divider/combiner which includes 90-degree phase shifter circuitry and is preferably implemented as a hybrid circuit module.

According to the present invention, an antenna coupler network of the type described above is located in a hollow interior space within the mounting base of the antenna. Coaxial cables connected to each conductor of each of the four elements located at the top of the mast are disposed through the hollow interior bore of the mast to terminals of the coupler network. In an example embodiment of the invention, the two coaxial cables consist of a first, 0-degree cable connected to the 0-degree port of a hybrid coupler network located in the base, and a second, 90-degree phase cable connected to the 90-degree port of the coupler network.

According to the invention, the two coaxial cables disposed upwards through the bore of the mast are electrically connected to a circular disk-shaped printed circuit board (PCB) which is mounted coaxially in the mast bore, near the upper transverse end of the mast. The PCB board also has depending downwardly therefrom interconnected lengths of coaxial cable which produce 180-degree phase shifted signals for driving opposed conductors of each of the two pairs of dipole elements. The PCB board thus has four antenna element connection terminals. Each of the PCB board element connection terminals is electrically connected to a separate one of four electrically conductive antenna element mounts which are attached to the outer circumferential wall surface of the outer, fiberglass shell of the mast.

According to the invention, there are four antenna element mounts spaced circumferentially apart at 90-degree intervals Each antenna element mount has a thin, arcuately curved rectangular plan view base plate which has an inner concave surface that has the same radius of curvature as that of the outer surface of the mast housing, so that the base plate can fit conformally to the mast housing.

Each antenna element mount also has protruding radially outwardly from the outer convex surface of the base plate a cylindrically-shaped, circular cross-section boss which has disposed through its length a threaded bore which extends through the base plate.

The four antenna element mounts are attached to the outer surface of the antenna mast housing near the upper transverse end of the housing, with the upper transverse edge of each rectangular antenna element mount base plate aligned with the upper transverse annular end wall of the mast. Each antenna element mount is securely fastened to the antenna mast housing, as by a pair of screws inserted into a pair of holes located on opposite sides of the base plate and tightened into a pair of aligned holes through the mast housing. Each antenna element mount is made of an electrically conductive material, such as aluminum or stainless steel, and the internal threaded bore of each mount is electrically conductively connected to a separate one of the four output terminals of the PCB, by a screw disposed perpendicularly downwards through a conductive metal bushing which contacts the upper surface of a strip conductor on the PCB. The screw depends perpendicularly downwards through a hanger flange bracket which protrudes perpendicularly inwards from the upper edge of the antenna element mount into a notch formed in the upper transverse annular end wall of the mast housing.

According to the invention each of the four antenna elements is removably attachable to a separate one of the internally threaded antenna element mounts by an externally threaded stud which extends perpendicularly outwards from the center of the inner transverse end face of the element. The stud protruding from each antenna element is electrically conductively connected to the straight electrically conductive tubular shell of the element. Preferably, the inner annular ring-shaped peripheral end face of each antenna element which encircles the protruding threaded stud has adhesively adhered thereto a lock washer which is slipped onto the stud and pressed against the annular end face.

With the foregoing construction, a complete impact resistant UHF SATCOM antenna with field replaceable elements according to the present invention can be stored and shipped in a rectangular carton which has a length equal to the height of the antenna mast plus the height of coaxial connectors which protrude perpendicularly downwards from the lower surface of the antenna base plate. The cross-section dimension of the storage and shipping carton need not be any larger than the cross-section of the rectangular antenna base plate. This efficient packing method for storage and shipment is made possible because each of the four loose antenna elements has a length less than that of the antenna mast, and can thus be laid alongside the mast and secured thereto with layers of bubble wrap or other protective shipping filler material. When the antenna arrives at a use location, is can be rapidly assembled by threading the four antenna elements into the bores of the four antenna element mounts, applying a layer of LOCTITE or similar adhesive to the face of the lock washer and tightening the threaded element stud into the element mount bore by hand, or by a wrench which engages a pair of parallel flats formed in diametrically opposed wall surface of each element housing, which extend a short distance longitudinally outwards from the inner annular end face of the antenna element.

An antenna according to the present invention and described above is inherently very rugged and impact resistant. However, if any element of the antenna suffers catastrophic damage in the field, it can be readily replaced by unscrewing the element from its mount, using an open-end wrench or pliers, and quickly and easily replaced with an undamaged element.

In a foldable modification of the basic embodiment of an impact resistant UHF SATCOM X-WING antenna described above, each of the four elements is attached to the upper end of the antenna mast by a separate tensioned socket joint. This construction enables the elements to be pulled outwardly from a socket joint and folded downwardly and parallel to the longitudinal axis of the antenna mast to minimize the antenna profile for storage and shipment when not in operation, and orbited upwardly and inserted into sockets which lock the elements into radially perpendicular orientations from the antenna mast when the antenna is used to transmit and receive signals.

The four antenna element mounts for the foldable antenna according to the present invention are similar in construction and mounting locations to those of the replaceable element antenna described above, with the following modifications.

The antenna element support boss of each antenna element of the foldable antenna according to the invention has disposed radially inwardly from the outer longitudinally disposed circular face thereof a tapered, smooth wall blind bore instead of the helically threaded, uniform internal diameter bore disposed through the length of the support bosses used in the replaceable element antenna. The smooth-wall, blind bore in the antenna element support boss of each antenna mount has a tapered, frusto-conic shape, terminated in an inner end wall disposed transversely to the longitudinal axis of the bore and constitutes a socket for supporting an antenna element. The inner end wall is of smaller diameter than the outer entrance opening of the bore. The foldable antenna support boss also has cut into the lower side of the outer longitudinally disposed annular wall thereof a vertically disposed, rectangularly-shaped slot which penetrates the inner cylindrical wall surface of the bore and extends downwardly through a flat formed in the lower side of the outer cylindrical wall surface of the boss, and radially inwardly about half the radial length of the boss.

According to the invention, each of the four antenna elements of the foldable antenna has protruding longitudinally from an inner end thereof a tapered, frusto-conically shaped support peg which is of the proper size and shape to be insertably received in an interference fit in the tapered socket bore of the element mount boss. The support peg is an integral part of a circular cross-section body which has a cylindrically-shaped plug portion that is fitted into an open inner end of a tubular antenna element housing, and secured to the housing. The plug portion of the body has an inner cylindrical part which has at one end thereof a transverse face that is aligned with the inner transverse end wall of the element housing. The frusto-conic support peg has a base diameter which is smaller than the outer diameter of the plug, and is coaxially centrally located on the face of the plug, thus forming a flat transversely disposed annular ring-shaped end face on the plug.

According to the invention, each element of the foldable antenna includes a tensioning mechanism to maintain a radially inwardly directed force on the element which retains the element support peg aligned within the element mount socket bore. In a preferred embodiment, the tensioning mechanism includes longitudinally disposed within the bore of each element, a longitudinally elongated helical tension spring which has an end portion that fits into a blind cylindrical bore which extends inwardly into an outer transverse end wall of the outer end of the plug, which is located within the bore of the element. The spring is longitudinally movably located within a cylindrical guide tube which is mounted in the blind cylindrical bore in the outer face of the plug and extends into the tubular element housing for an appreciable fraction of the length of the spring. The outer transverse end of the spring is capped by a cylindrically-shaped stop sleeve, which has attached thereto a flexible wire cable which extends longitudinally inwardly through the central bore of the spring, and out through a cable hole which is disposed longitudinally through the center of the transverse end wall of the spring holder bore in the plug, and outwardly through the center of the outer transverse end face of the frusto-conic peg.

The inner end portion of the tensioning cable extends through a cable bore that extends through the center of the inner transverse end face of the frusto-conic socket bore in the element mount boss, and into the interior of the antenna mast. The inner end of the tensioning cable is secured against radially outward movement by an inner stop bushing which is fastened to the inner end of the cable, and retained in a cup-shaped blind bore which extends into the inner longitudinally disposed end wall of the mounting base.

With the foregoing construction, each antenna element may be re-configured from an operational use position, in which the antenna element support peg is secured with the socket bore of an element mount by tension in the spring within the element, to a downwardly oriented stowed position by grasping the element and pulling it radially outwardly from the antenna mount sufficiently far for the support peg to be withdrawn from the support peg socket bore in the antenna element mount. Thus freed, the element may be folded downwardly towards an orientation parallel to the mast, with the tension cable sliding into the slot in the lower wall of the element mount boss. In this position, the tensioning spring forces the flat inner transverse end face of the antenna element support peg into compressive contact with the lower surface of a flat formed in the lower side of the element support boss, thus retaining the element in a folded position.

To re-configure an antenna element from a stowed orientation to an operational orientation, each antenna element is grasped and pulled downwardly to unseat the flat end of the antenna element support peg from the bottom flat of the element mount, and swung upwardly in an arc until the peg is aligned with an element mount socket bore, whereupon pulling tension on the element is released, thus enabling tension in the element spring to pull the peg into the element mount socket bore and thus secure the element in a radially outwardly disposed operational orientation.

DESCRIPTION OF THE PREFERRED EMBODIMENTS

FIGS. 1-12 illustrate a basic embodiment of an X-WING UHF SATCOM antenna according to the present invention, which has replaceable elements.

FIGS. 13-28 illustrate a modification of the antenna shown in FIGS. 1-12, which has foldable elements.

Figure 1:
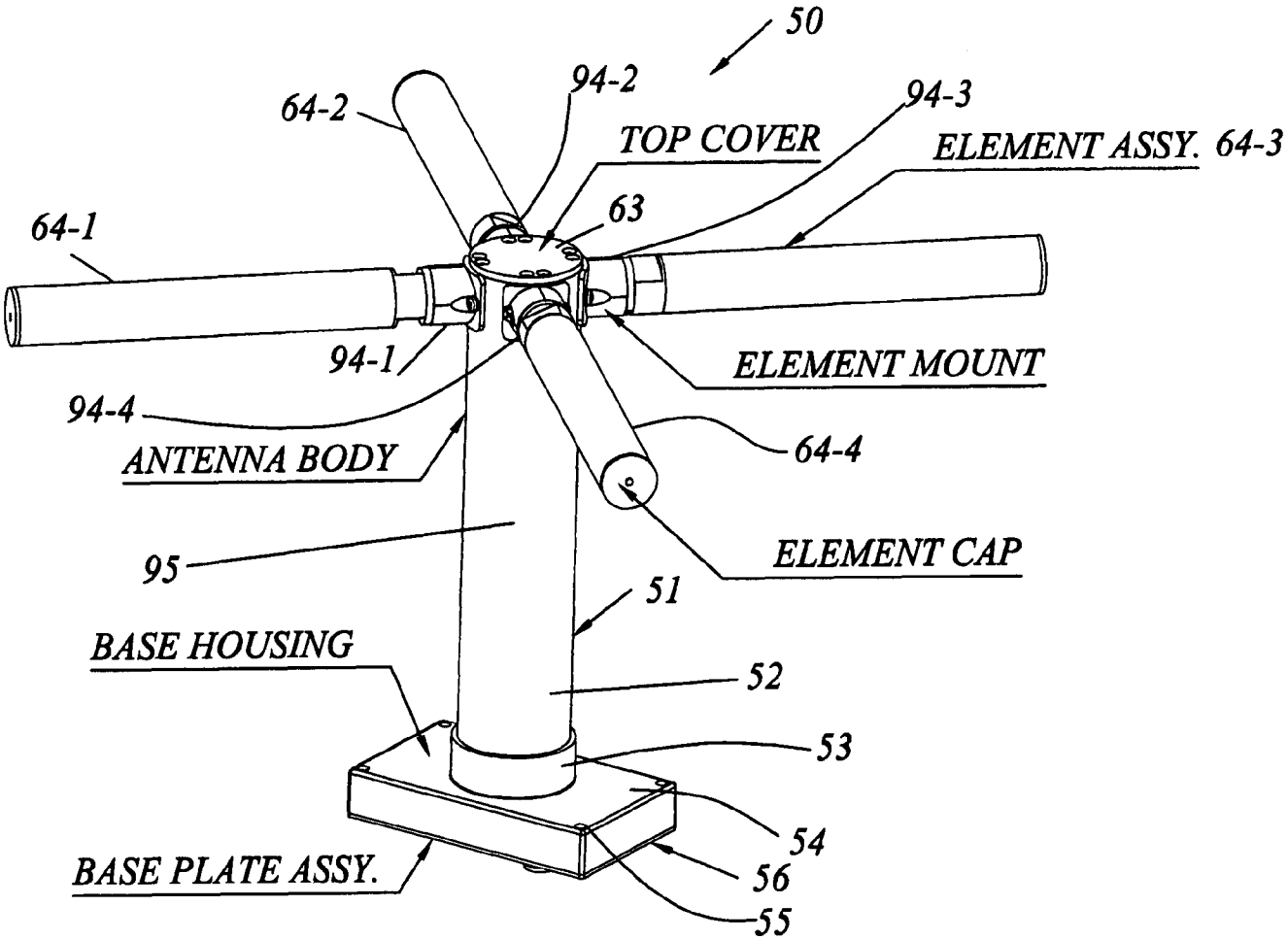
FIG. 1 is an upper perspective view of a replaceable element, impact resistant antenna according to the present invention.
Figure 2:
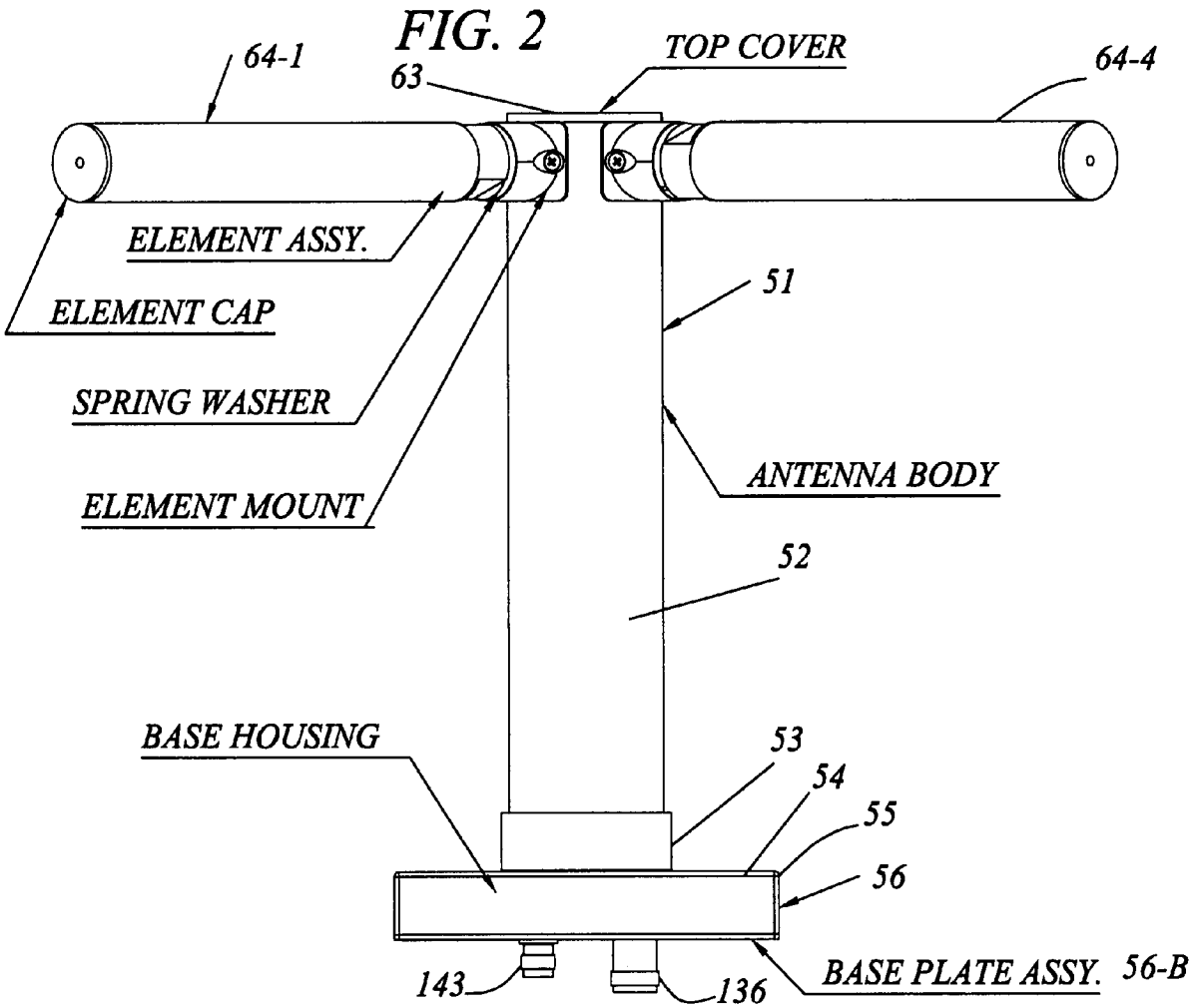
FIG. 2 is a front element view of the antenna of FIG. 1.

Referring first to FIGS. 1 and 2, an impact resistant X-WING UHF SATCOM antenna 50 with replaceable elements may be seen to include a mast 51 having an elongated, straight vertically disposed hollow cylindrical circular cross-section housing 52. The lower end of housing 52 fits into a short circular cross-section, ring-shape support boss 53 that protrudes upwardly from the center of the upper surface 54 of a rectangular upper cover plate 55 of a thin rectangular box-shaped base housing 56.

Figure 3:
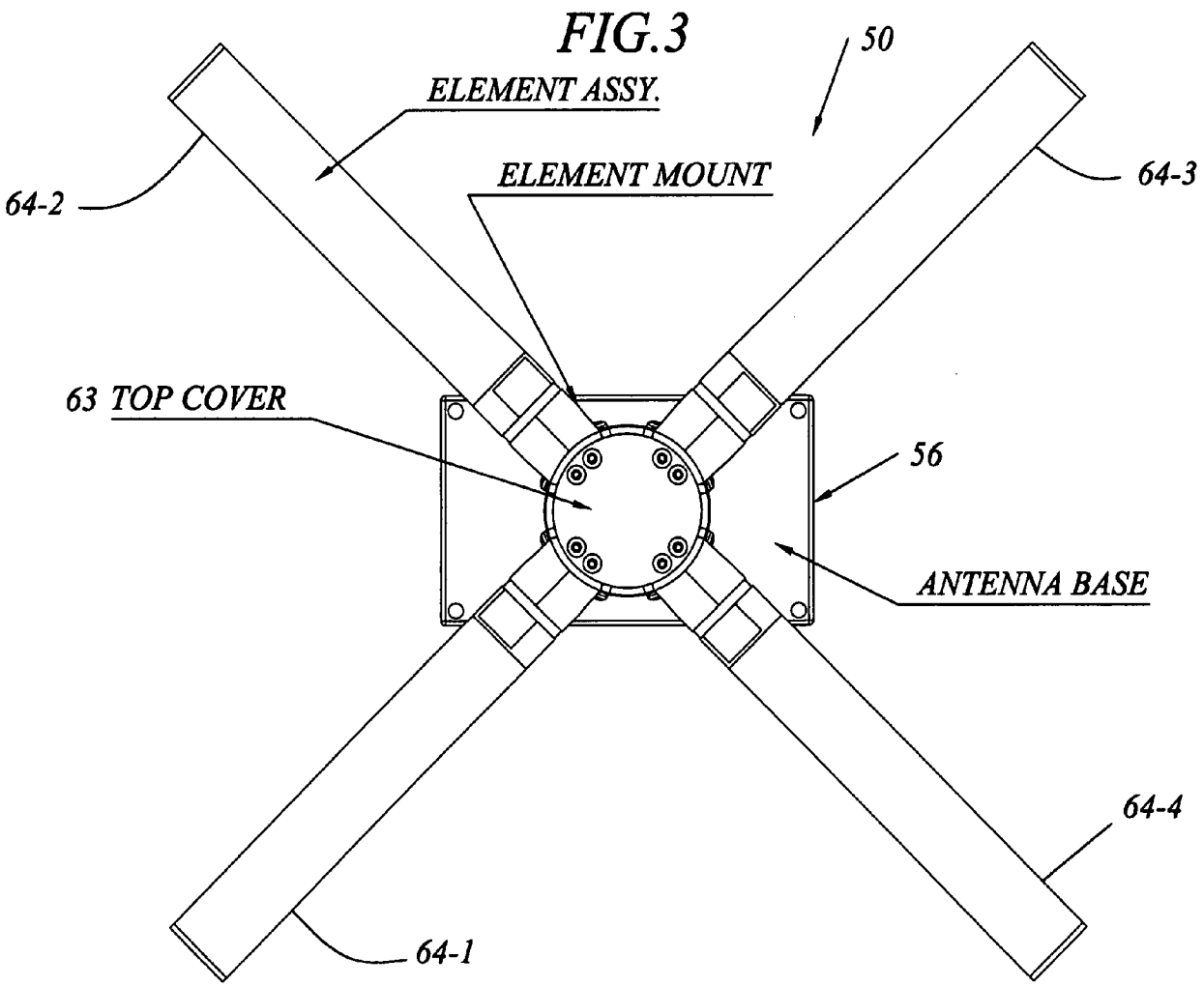
FIG. 3 is an upper plan view of the antenna of FIG. 1.
Figure 6:
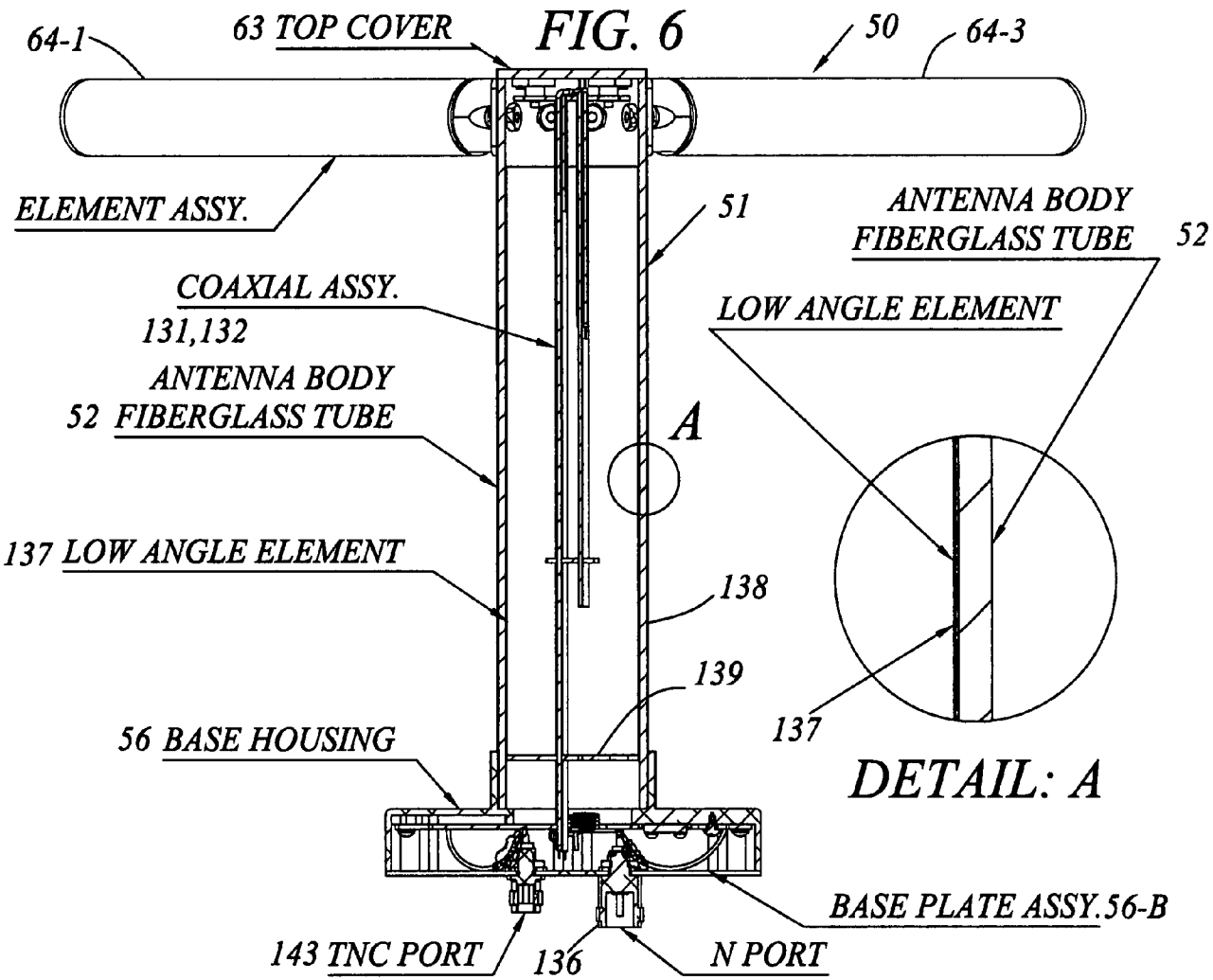

As shown in FIG. 6, housing 52 of antenna mast 51 has the shape of an elongated, thin wall circular cross-section cylindrical shell. The housing 52 is made of a durable electrically non-conductive material, such as fiberglass. As shown in FIGS. 3 and 6, housing 52 has disposed through its length a circular cross-section bore 57, which extends from the lower transverse annular end wall 58 to the upper transverse end wall 59 of the mast housing.

Figure 4:
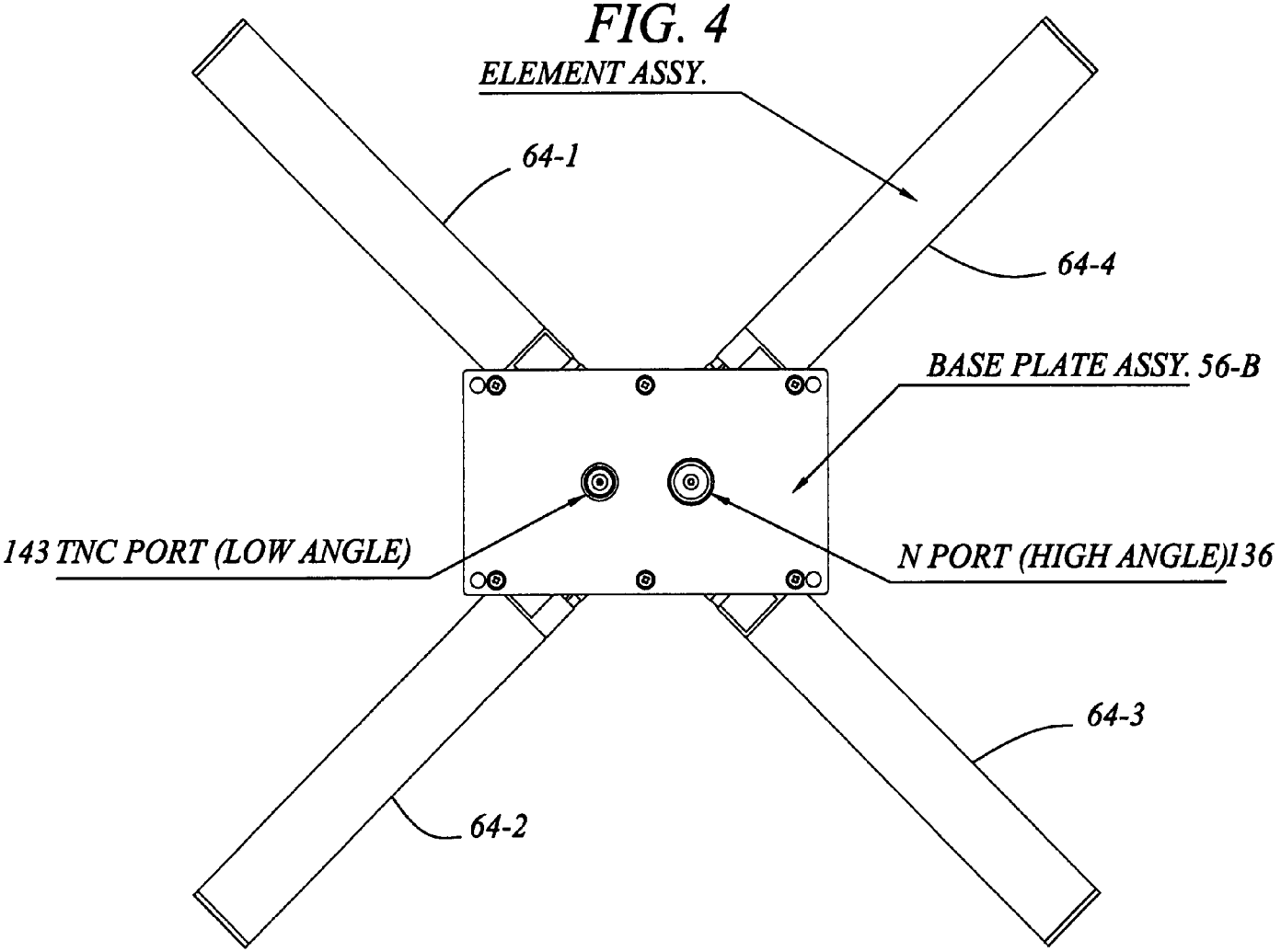
FIG. 4 is a lower plan view of the antenna of FIG. 1.

As shown in FIGS. 2, 4 and 6, base housing 56 has generally the shape of a thin rectangular cross-section box which has disposed through the upper rectangular plate cover 55 thereof a centrally located circular aperture 60 which communicates with a rectangular block-shaped, hollow interior space 61 of the base housing. Base housing also has a lower rectangular base plate 56-B. Aperture 60 has a smaller diameter than that of ring-shaped antenna mast support boss 53, which coaxially overlies the aperture, thus forming a flat annular ring-shaped shoulder ledge 62, which supports the lower transverse end wall of mast housing 52. The mast housing 52 is secured to mast support boss 53 by an adhesive bond.

Referring to FIGS. 1, 3 and 6, it may be seen that the upper opening of bore 57 through mast housing 52 is closed by a circular top cover 63.

As shown in FIGS. 1 and 3, antenna 50 includes four identical straight cylindrically shaped, circular cross-section tubular elements 64-1, 64-2, 64-3, 64-4. Each element has a length less than the height of mast 51 above upper surface 54 of base housing cover plate 55, and a diameter less than that of the mast housing 52. As shown in FIGS. 3 and 6, the four antenna elements 64 protrude radially in a horizontal plane perpendicularly outwards from the outer circumferential wall surface 65 of mast housing 52.

Figure 11:
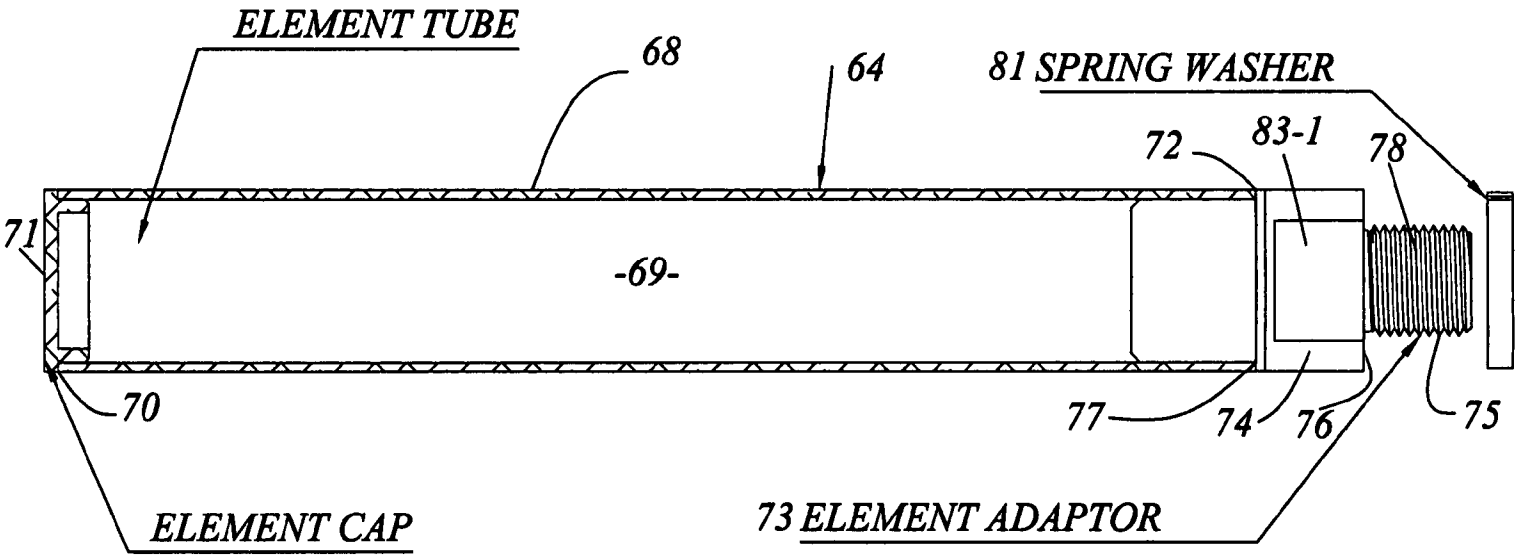
FIG. 11 is an elevation view of an element of FIG. 10, on an enlarged scale.

As shown in FIG. 11, each antenna element 64 includes an elongated, straight hollow circular cross-section cylindrically shaped tubular housing 68 which has longitudinally disposed through its length a bore 69. The antenna element housing 68 has an outer transverse end 70 that is covered by a circular element end cap 71 that has the same diameter as the outer diameter of element housing.

The tubular housing 68 of each antenna element 64 is made of aluminum or another such electrically conducting material and functions as the active component of the element in receiving and transmitting radio frequency electromagnetic waves.

As may be seen best by referring to FIG. 3, the four antenna elements 64-1, 64-2, 64-3, 64-4 are spaced circumferentially apart at 90-degree intervals. As will be described in detail below, each of the two pairs of diametrically opposed elements, e.g., 64-1/64-3, 64-2/64-4 is electrically configured as a dipole antenna 66-1, 66-2, respectively. The two dipole antennas are perpendicular to one another, thus forming a crossed dipole or X-WING antenna configuration. As is well known by those skilled in the art, the crossed dipole or X-WING configuration of antenna elements 64 is suitable for transmitting and receiving circularly polarized radio waves.

As shown in FIG. 11, the tubular housing 68 of each antenna element 64 has located at an inner transverse end wall 72 thereof an element adapter 73 for removably attaching the element to antenna masts. Each element adapter 73 is made of an electrically conductive material such as aluminum, and has generally the shape of cylindrical body 74 which has a same outer diameter as that of antenna element tubular housing 68, and a reduced diameter plug section 75 which extends outwardly from an outer transverse face 76 of the body. The plug section 75, which preferably has a knurled outer cylindrical surface, fits into the inner entrance opening 77 of the bore 69 in element housing 68, and is secured to the element housing by a press-fitted adhesive bond.

As shown in FIG. 11, element adapter structure 73 includes a straight threaded stud 78 which is coaxially aligned with the longitudinal axis of element housing 68. Stud 78 has a smaller diameter than that of adapter body 73, and extends perpendicularly from an inner transverse end face 79 of body 74. Preferably, stud 78 is received within central aperture 80 of an annular ring-shaped lock washer 81, which preferably is adhesively adhered to the inner transverse end face 79 of adapter body 74. Also, as shown in FIG. 11, body 73 preferably has formed in the outer cylindrical wall surface 82 thereof a pair of diametrically opposed, parallel, longitudinally disposed wrench flats 83-1, 83-2 to facilitate torquing element 64 about its longitudinal axis.

FIGS. 1 and 7-10 illustrate how antenna elements 64-1, 64-2, 64-3, 64-4 are removably attached to antenna mounts 94-1, 94-2, 94-3, 94-4.

As shown in FIG. 1, the four antenna mounts 94 are fastened to the outer cylindrical wall surface 95 of antenna mast housing 52 at circumferentially spaced apart intervals of 90 degrees, adjacent to the upper transverse end wall 59 of the mast housing.

Figure 7:
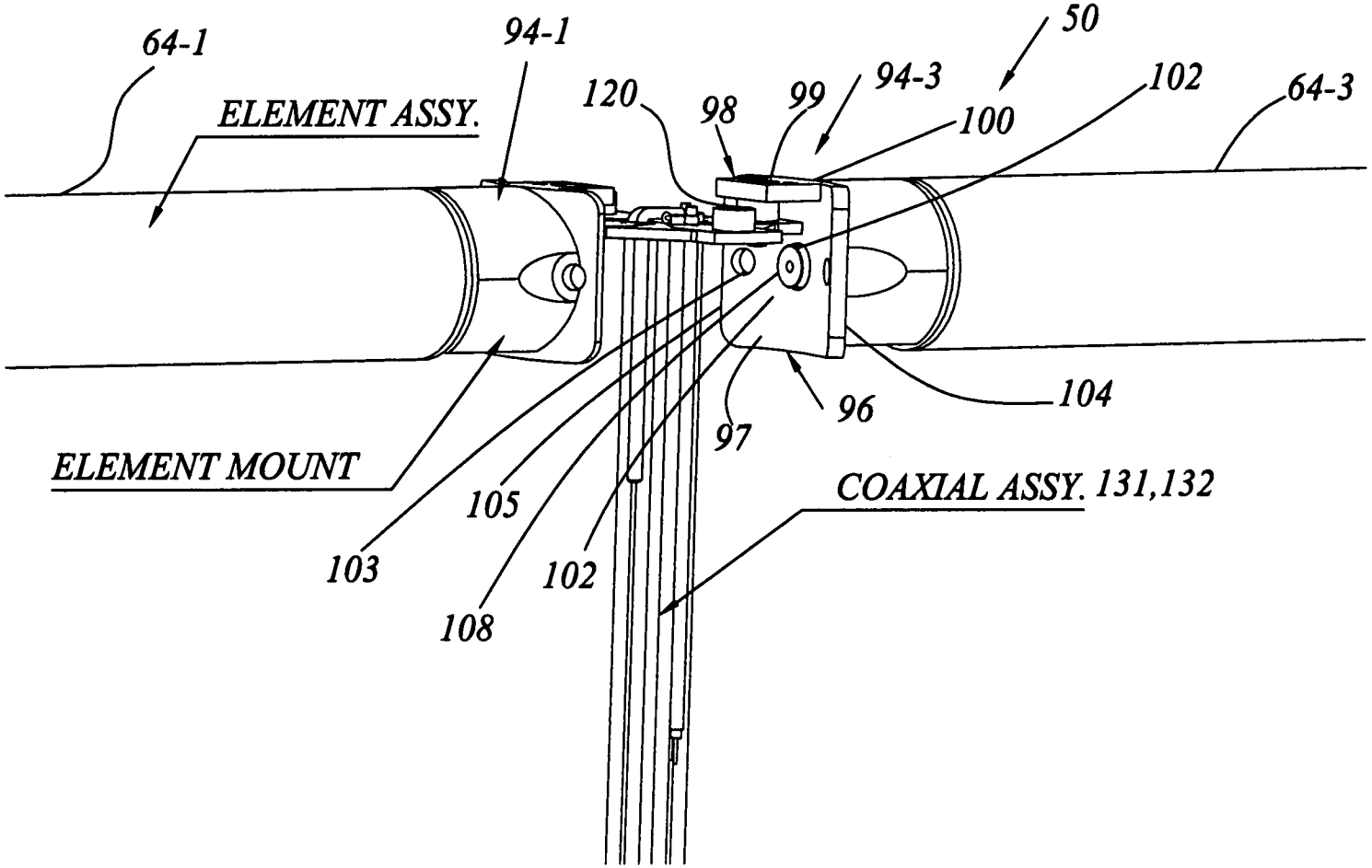
FIG. 7 is a fragmentary view of the antenna structure of FIG. 6, on an enlarged scale.
Figure 9:
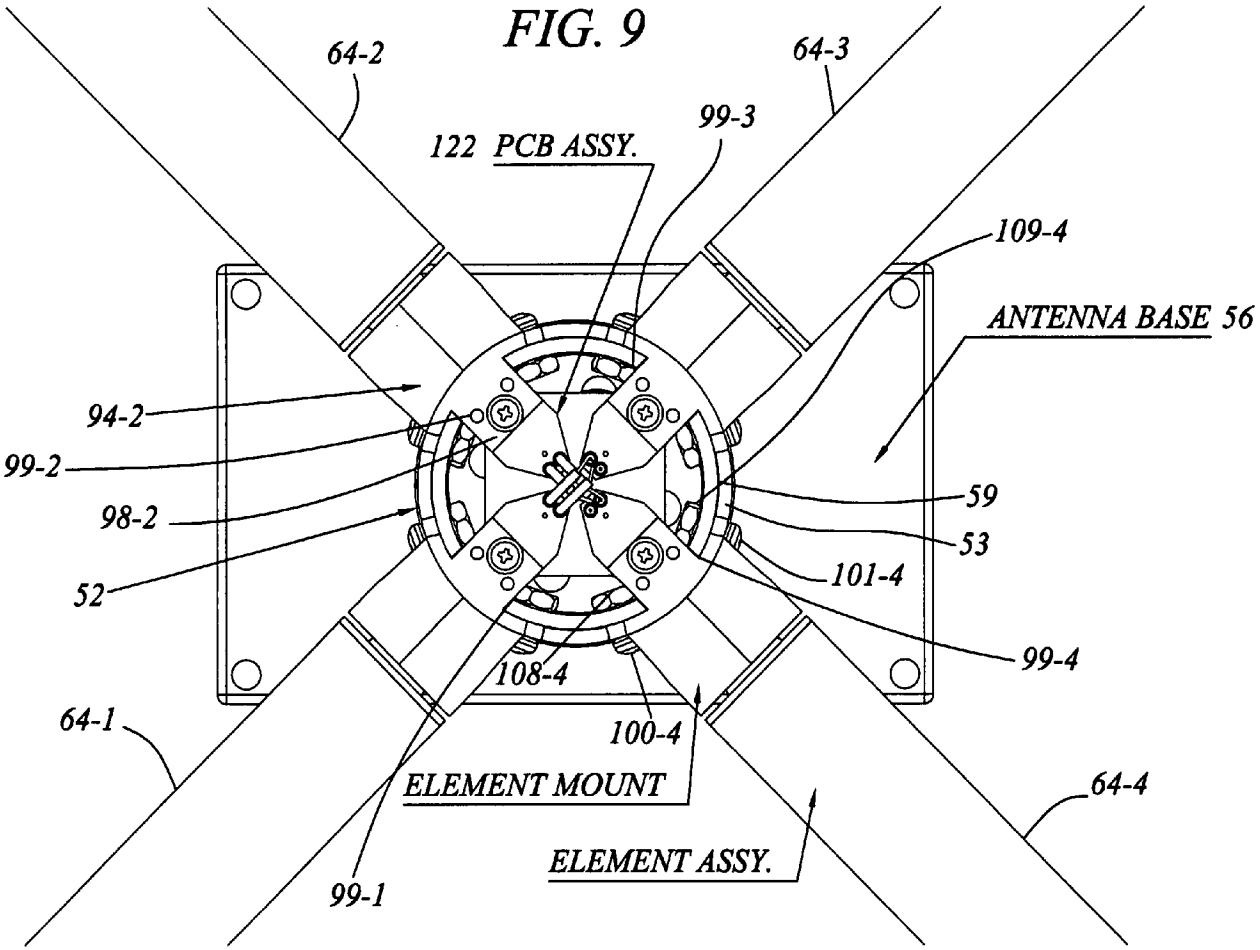
FIG. 9 is an upper plan view of the antenna of FIG. 1, with a top cover of the antenna removed.

As shown in FIGS. 7 and 9, each antenna element mount 94 has a thin uniform thickness, arcuately curved base plate 96 which has an inner longitudinally disposed arcuately curved surface 97 that has the same radius of curvature as outer cylindrical wall surface 95 of mast housing 52, so that the inner surface of the base plate can fit conformally to the outer surface of the mast housing. Each base plate 96 has protruding perpendicularly inwards of the inner surface 97 thereof a hanger bracket plate 98 which has a flat horizontally disposed upper surface 99 which is coextensive with the upper edge surface 100 of the base plate. As shown in FIGS. 7 and 9, hanger bracket plate 98 has a generally rectangular plan view shape, which has a width less than the circumferential arc length of the base plate.

Figure 10:
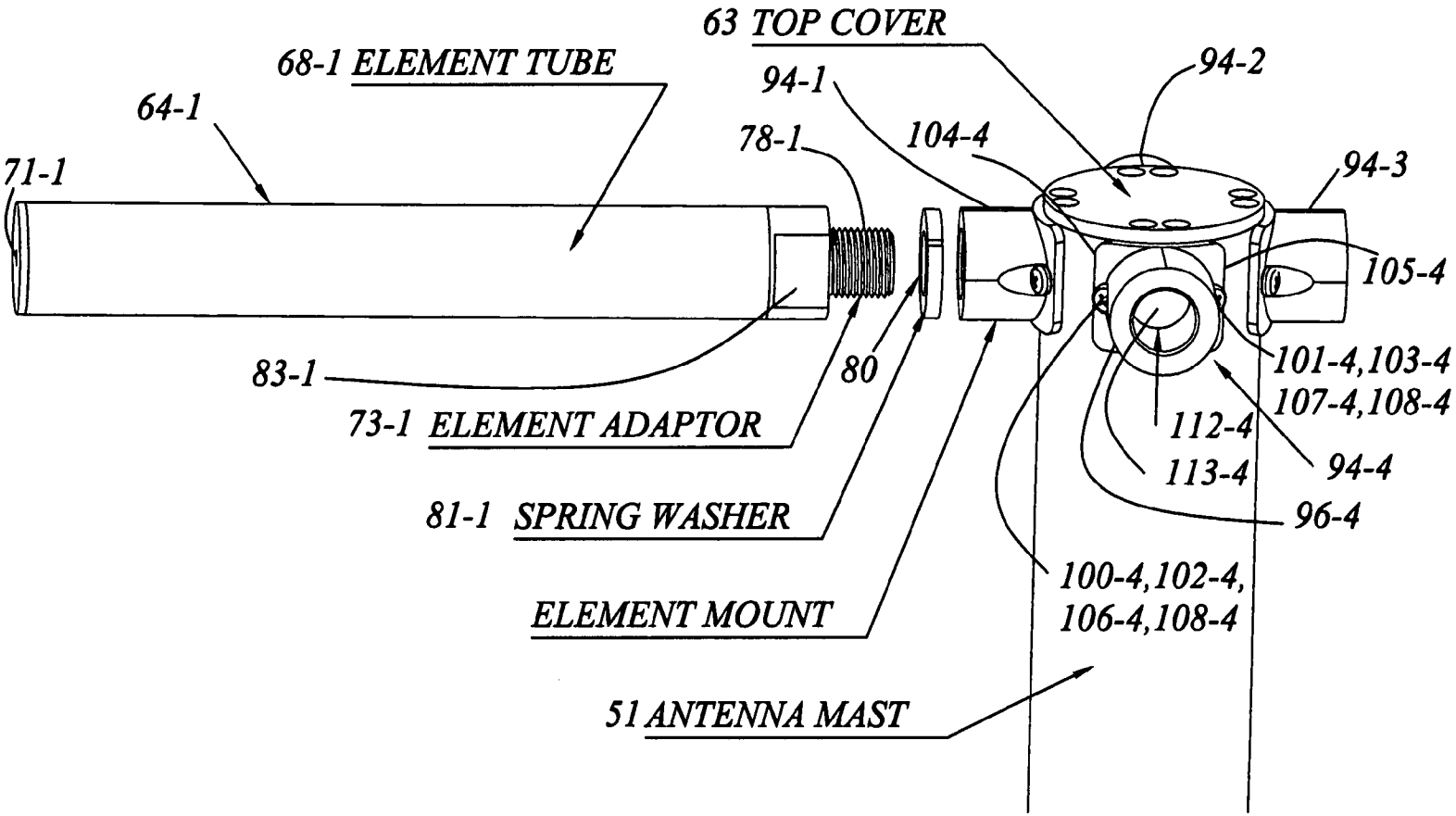
FIG. 10 is a fragmentary perspective view of the antenna of FIG. 1, showing how elements thereof are attached and removed.

As shown in FIG. 9, each hanger bracket plate 98 fits downwardly into a separate one of four rectangular notches 99-1, 99-2, 99-3, 99-4 which extend downwardly into upper transverse end wall 59 of antenna mast housing 52 at circumferentially spaced apart intervals of ninety degrees. As shown in FIGS. 9 and 10, each base plate 96 has a square outline shape, and is secured to mast housing 52 by a pair of circumferentially spaced apart screws 100, 101 which are inserted through holes 102, 103 located next to outer longitudinally disposed edges 104, 105 of the base plate, and through a pair of aligned hoes 106, 107 through mast housing 52 into bore 57 of the mast housing, where the nuts 108, 109 are tightened onto the threaded shanks of the screws.

As shown in FIG. 10, each antenna element mount 94 has protruding perpendicularly outwards from outer surface 110 of base plate 96 a circular cross-section, cylindrically-shaped boss 111. Each boss 111 has disposed through its length a threaded bore 112 which is aligned with a through-bore 113 disposed radially through mast housing 52. As shown in FIG. 10, the foregoing construction enables each antenna element 64 to be readily attached to and removed from an antenna element mount 94 by grasping the tubular housing 68 of the element and twisting it about its longitudinal axis to thus screw in the threaded stud 78 protruding inwardly from the inner end of the element into or out of the threaded bore 112 in the element mount boss 111. The element 64 may be further tightened or loosened by engaging flats 83 of the element within the jaws of an open-end wrench or pliers.

FIGS. 5 through 9 illustrate other components of antenna 50 which are connected with elements 64 included in mounts 94 to comprise an X-WING UHF SATCOM antenna which is operable to transmit and receive circularly polarized UHF radio waves through elements 64.

Figures 8, 8A, 8B:
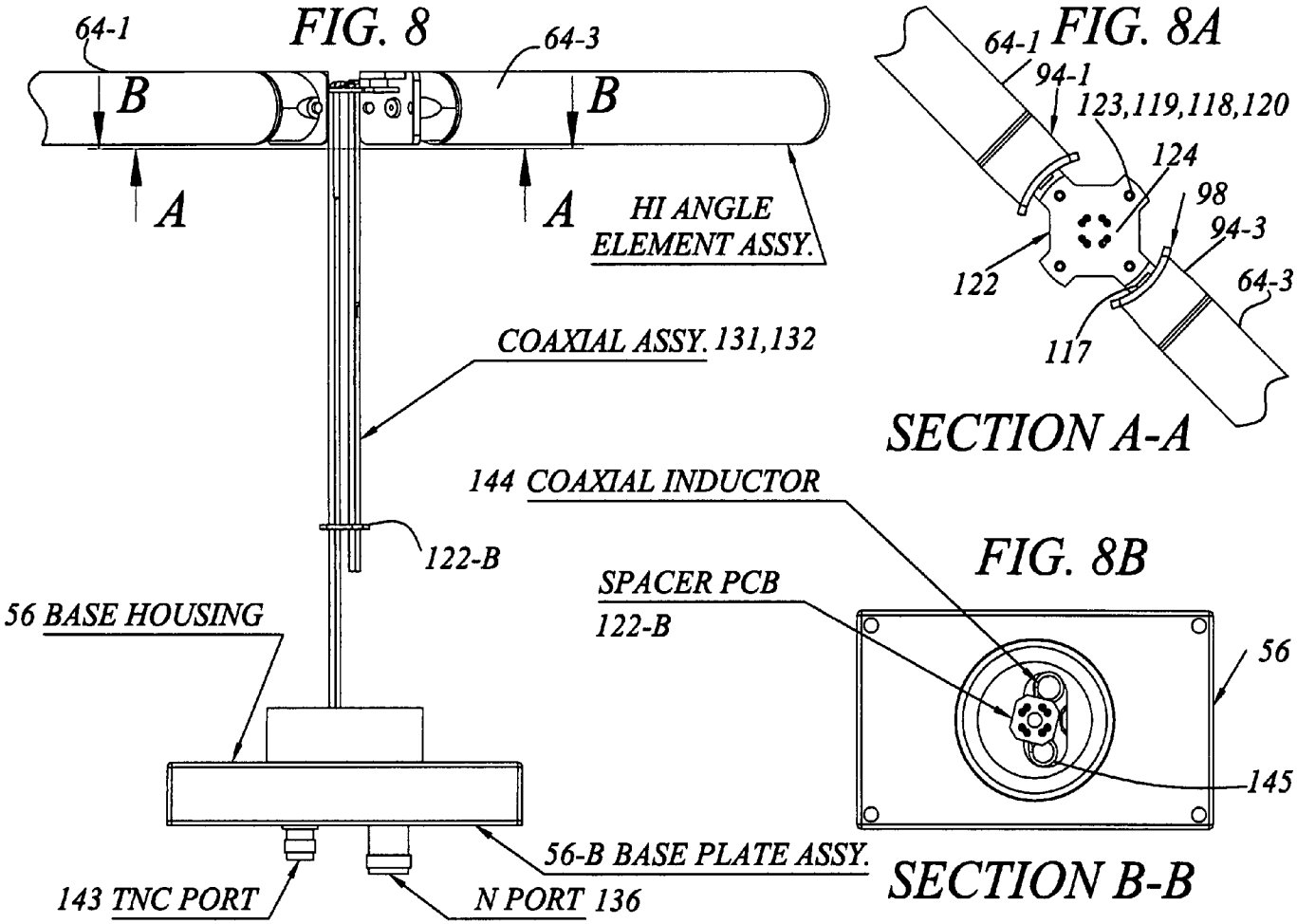
FIG. 8 is a fragmentary view of the antenna structure of FIG. 6.
FIG. 8A is a fragmentary lower plan view of the structure of FIG. 8.
FIG. 8B is a transverse sectional view of the antenna structure of FIG. 8, taken in the direction 8B-8B.

As shown in FIGS. 7-9, each rectangularly-shaped hanger bracket plate 98 of each antenna element mount 94 has a straight inner edge 114 which is perpendicular to the longitudinal axis of antenna element housing 51, and which is located radially inwards of the inner circumferential surface 115 of antenna mast housing 52.

As shown in FIGS. 7-9, each of the hanger bracket plates 98 has depending perpendicularly downwards from the lower surface 117 thereof the shank of a screw 118 which is disposed through a hole 119 near the inner edge 114, through a tubular conductive spacer bushing 120, through a hole 121 through a printed circuit board (PCB) 122 and through a nut 123 tightened onto the shank of the screw against the lower surface 124 of the PCB to thus support the PCB.

Figure 5:
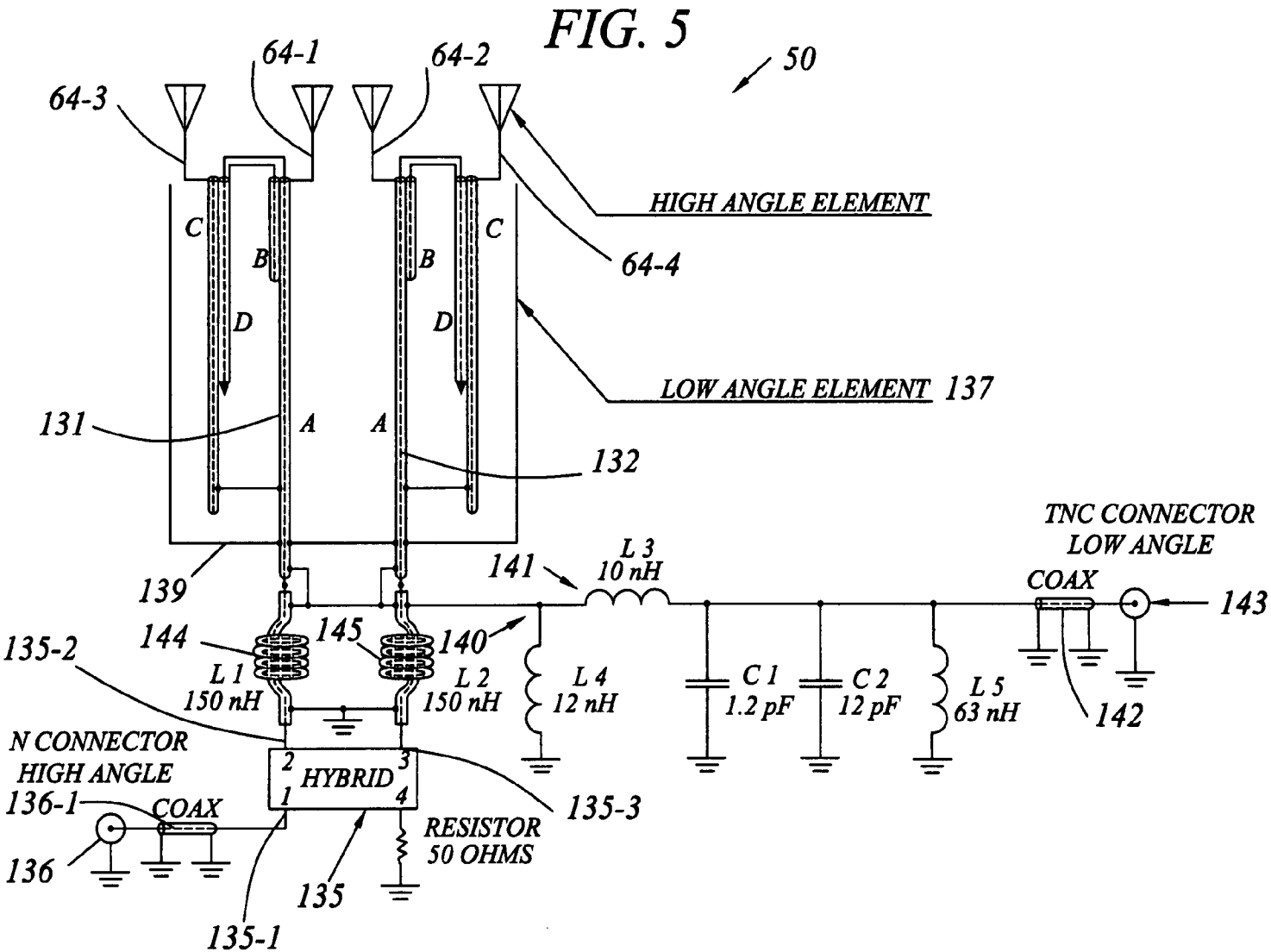
FIG. 5 is a schematic diagram of the antenna of FIG. 1.

As shown in FIGS. 5 and 9, PCB 122 has affixed to the upper surface 125 thereof strip-line conductors 126 which connect at outer radial ends thereof to conductive spacer bushings 120, and at inner radial ends thereof to conductive metal eyelet pairs 127, 128.

As shown in FIGS. 5, 6, and 7 there are four eyelet pairs 127-1, 127-2, 127-3 and 127-4. Two sets of eyelet pairs 127, 128-1 are connected to the center and outer conductors 129, 130-1 of a pair of coaxial cables 131, 132, which are disposed perpendicularly downwards form the PCB 122 through antenna mast housing 57 to a hybrid antenna coupler 135 in base housing 56.

Figure 12:
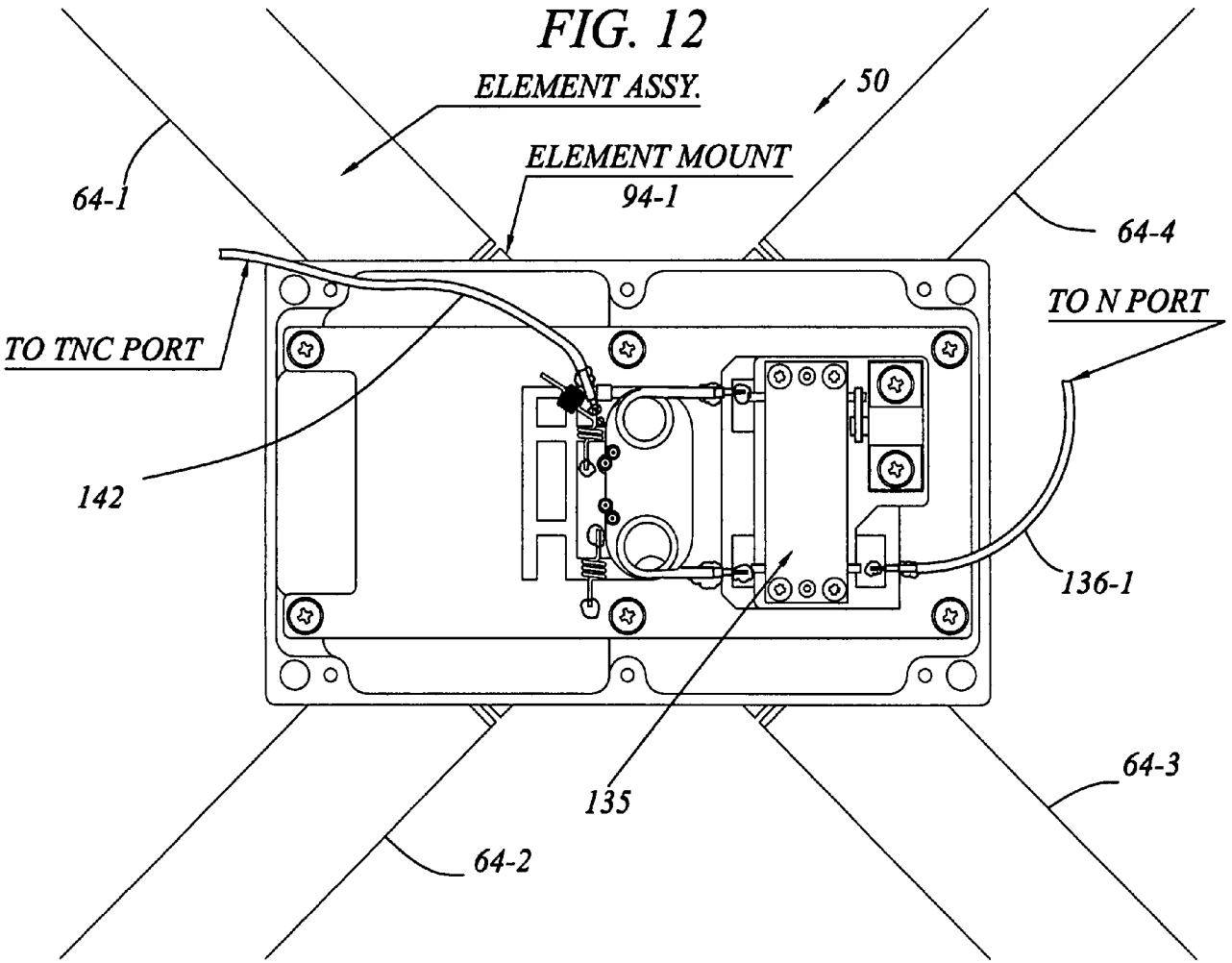
FIG. 12 is a fragmentary lower plan view of the antenna of FIG. 1, showing a lower cover plate removed from the base of the antenna.

As shown in FIGS. 6 and 12, the coaxial cables 131, 132 are electrically connected at lower ends thereof located within the hollow interior space 61 of base housing 56 of antenna 50 to a 0-degree port 135-2 and a 90-degree port 135-3 of hybrid antenna coupler 135 located in the interior space of the housing. Hybrid antenna coupler 135 is a reciprocal device, which has a first interface port 135-1, which in a transmit mode receives a modulated UHF radio signal input to a "high-angle", i.e., circular polarization mode coaxial N-connector 136 through a high angle mode, i.e., circular polarization mode, coaxial cable 136-1. Connector 136 is mounted in a hole that penetrates base plate 56-B of housing 56.

Hybrid antenna coupler 135 functions in a transmit mode as a power divider, splitting the power input to first interface port 135-1 into a first, 0-degree signal at 0-degree port 135-2 which has one-half the input power level, i.e., is attenuated by 3-db. Similarly, a second, 90-degree antenna signal shifted in phase by 90-degrees from the 0-degree signal and also attenuated by 3-db, is output at hybrid terminal 135-3. The two signals, separated in phase by 90 degrees, when input to 90-degree displaced dipole pairs comprised of elements 64-1/64-3, 64-2/64-4, cause the antenna to launch right-hand circularly polarized (RHCP) electromagnetic waves axially from the elements, i.e., along the longitudinal axis of antenna housing 52.

Hybrid antenna coupler 135, which, as stated above, is a reciprocal device is also effective in a receive mode of operation of combining 90-degree phase shifted signals induced in dipole pairs 64-1/64-3, 64-2/64-4 by a circularly polarized signal received and input to antenna ports 135-2, 135-3, to a single-phase output signal at interface port 135-1 of the hybrid network.

As shown in FIGS. 1 and 6, antenna 50 optionally and preferably includes additional components which enable the antenna to transmit and receive linearly polarized radio waves. Thus, as shown in FIGS. 5 and 6, antenna 50 preferably includes a cylindrical cup-shaped eclectically conductive shell 137 which is contained coaxially within the bore 57 of antenna housing mast 52. The shell 137 has a cylindrical body 138 which is terminated at the lower end thereof by a circular disk-shaped electrically conductive base 139. Base 139 of shell 137 is electrically conductively connected to an antenna port 140 of a band pass filter 141, which is connected through a "low-angle" coaxial cable 142 to a low-angle interface port coaxial connector 143, as shown in FIG. 5. Connector 143 is mounted in a hole that penetrates base plate 56B of housing 56. A pair of coiled coaxial inductors 144, 145 are connected in series with the two hybrid antenna coupler ports 135-2, 135-4 to provide electrical isolation between operation of the low-angle antenna conductor 137, which is effective in transmitting and receiving signals which are linearly polarized in a direction parallel to the longitudinal axis of antenna housing 52, i.e., vertically polarized signals, and circularly polarized signals transmitted and received by radially disposed elements 64.

FIGS. 13-28 illustrate a modification 150 of the replaceable antenna element 50 shown in FIGS. 1-12 and described above. Modified antenna 150 is substantially similar in electrical function to replaceable element antenna 50. However, antenna 150 utilizes radially disposed elements which are attached to the mast of antenna by a novel construction which enables the elements to be folded downward to a small profile for storage and shipment configuration, and foldable upward to a radially disposed operational configuration.

Figure 13:
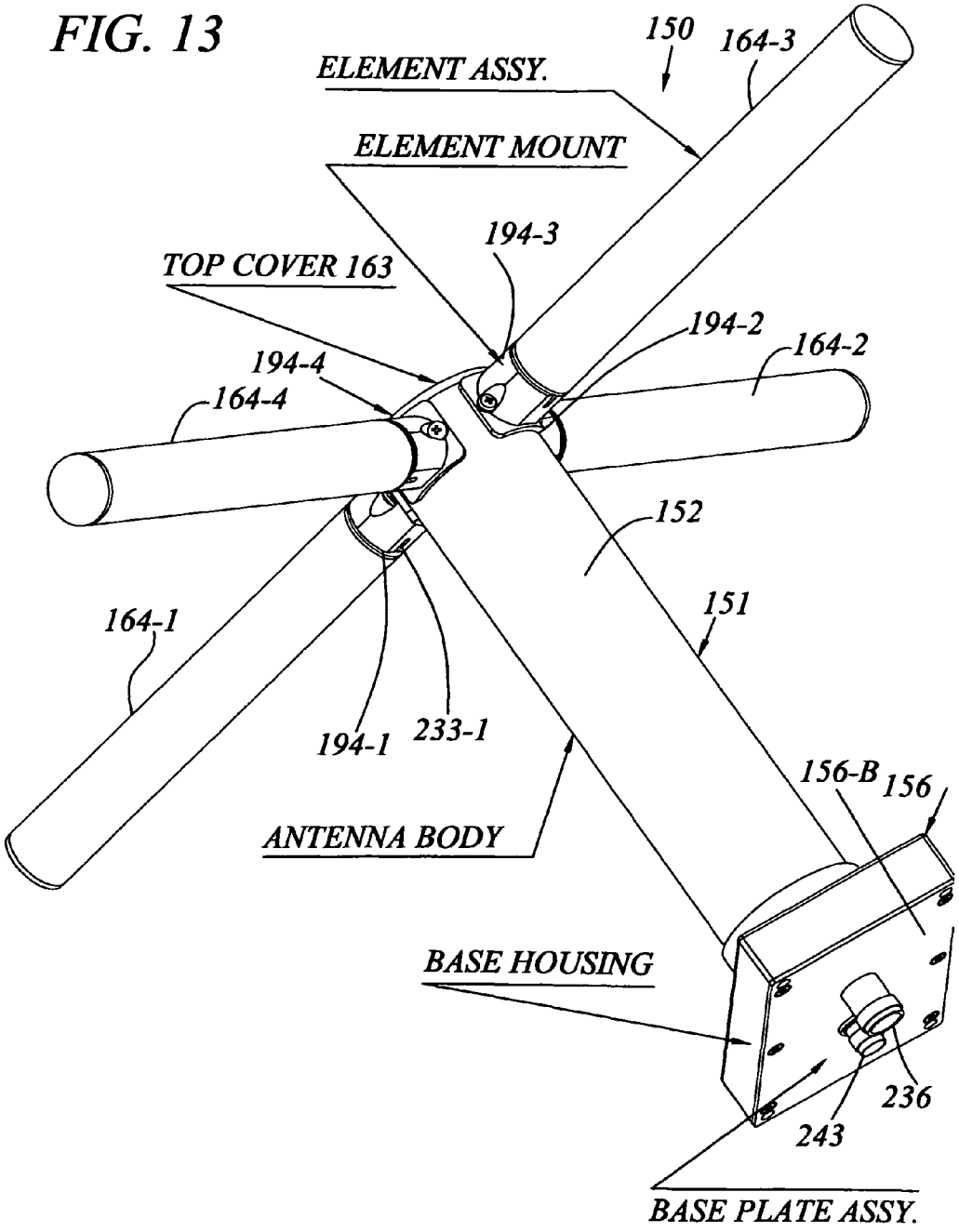
FIG. 13 is a lower perspective view of a foldable element, impact resistant antenna according to the present invention.
Figure 14:
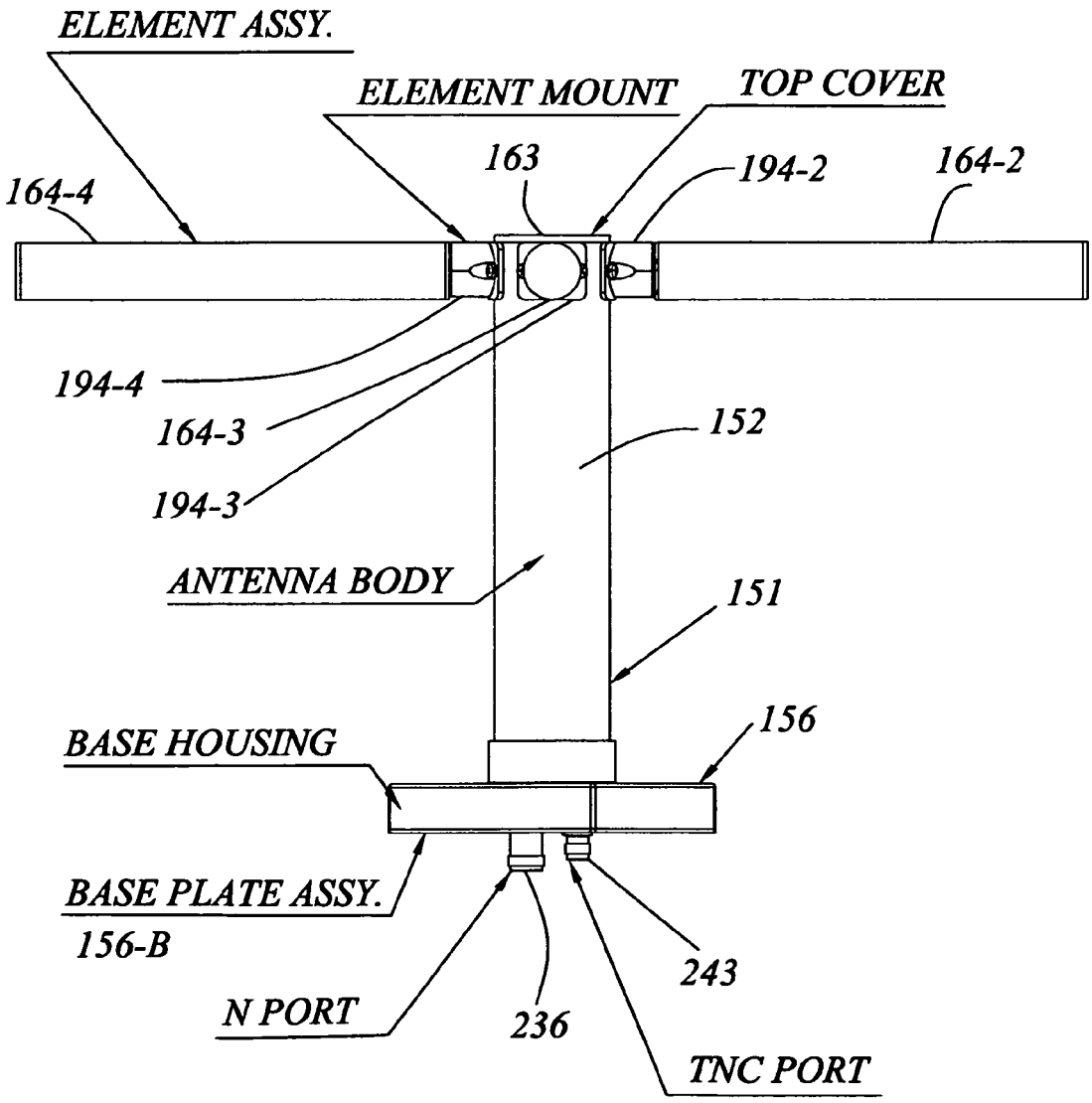
FIG. 14 is a front elevation view of the antenna of FIG. 13.

Referring now to FIG. 13, it may be seen that an impact resistant X-WING UHF SATCOM antenna 150 with foldable elements has an external appearance and construction which are substantially similar to that of replaceable element antenna 50 described above. Thus foldable element antenna 150 has a base housing 156, an elongated tubular mast 151 which extends perpendicularly upwards from the center of an upper cover plate 155 of a base housing 156, and four elements 164 which protrude radially outwards from the outer cylindrical wall surface 165 of mast housing 152 at 90-degree circumferential intervals.

As shown in FIGS. 20-25, each antenna element 164 includes an elongated, straight hollow circular cross-section cylindrically-shaped tubular electrically conductive housing 168 which has disposed through its length a bore 169. Each antenna element housing 168 has an outer transverse end 170 that is covered by a circular element end cap 171 that has the same diameter as the outer diameter of the element housing.

Figure 17:
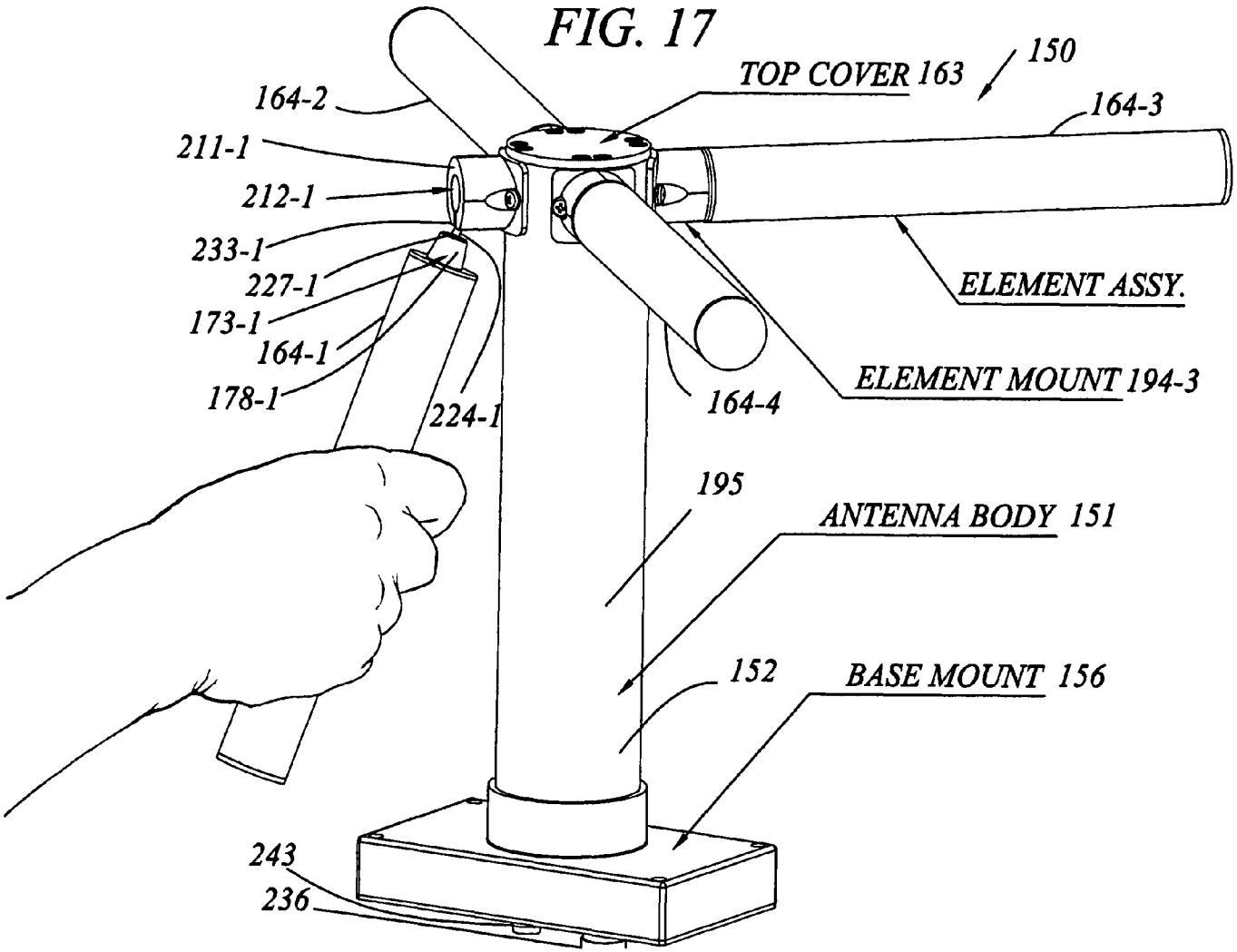
FIG. 17 is a view similar to that of FIG. 16, showing a third step in folding the element down, and second step in folding the element up.
Figure 21:
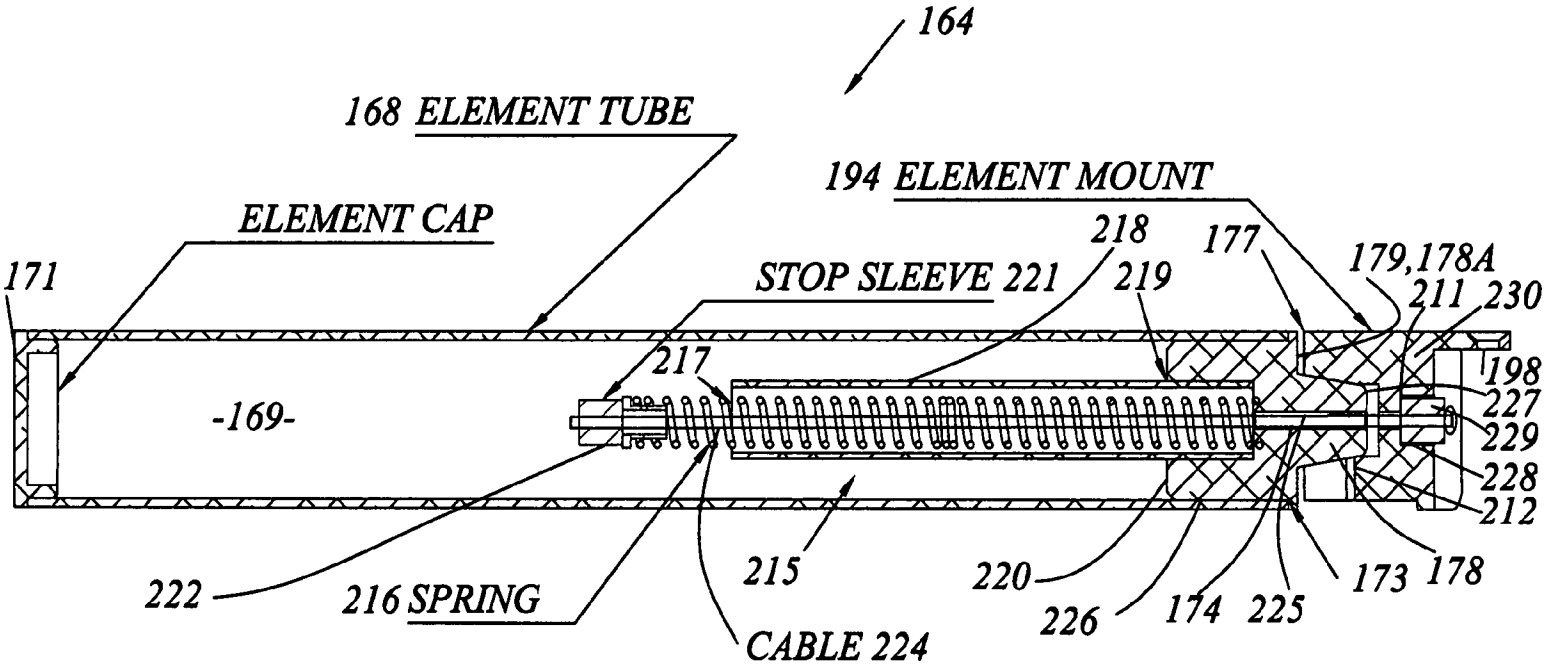
FIG. 21 is a medial vertical sectional view of the element of FIG. 20 showing the element attached to an antenna element mount of the antenna of FIG. 1.

As shown in FIGS. 17 and 21, each of the four antenna elements 164 of foldable antenna 150 has located at an inner transverse end 172 thereof an element adapter 173 for attaching the element to a separate one of four antenna mounts 194 attached to the outer cylindrical wall surface 195 of antenna mast housing 152 at circumferentially spaced apart intervals of 90 degrees, adjacent to the upper transverse end wall 159 of the mast housing. Each element adapter 173 is made of an electrically conductive material such as aluminum, and has generally the shape of a circular cross-section body 174 which has an outer cylindrical plug section 175 that preferably has a knurled surface, fits into the inner entrance opening 177 of the bore 169 in element housing 168, and is secured to the housing in electrically conductive contact therewith by an adhesive bond.

As shown in FIGS. 17 and 21, each element adapter 173 includes a frusto-conically shaped, tapered antenna element support peg 178 which extends perpendicularly from an inner transverse end face 179 of plug section 175 of body 174. Support peg 178 has a smaller base diameter than the diameter of body 174, and is coaxially aligned with the plug section of the body and tubular element housing 168 into which the plug section 175 of the body fits. A transversely disposed flat annular ring-shaped flange surface 178A is formed in the transverse end face of plug section 175 of body 174.

Referring still to FIGS. 17 and 21, it may be seen that the support peg 178 of each antenna element 164 is receivable in a socket bore 212 of separate antenna element mount 194. Thus, as shown in the figures, each antenna element mount 194 has a thin uniform thickness, arcuately curved base plate 196 which has an inner longitudinally disposed arcuately curved surface 197 that has the same radius of curvature as outer cylindrical wall surface 195 of mast housing 152, so that the inner surface of the base plate can fit conformally to the outer surface of the mast housing. Each base plate 196 has protruding perpendicularly inwards of the inner surface 197 thereof a hanger bracket plate 198 which has a flat horizontally disposed upper surface 199 which is coextensive with the upper edge surface 200 of the base plate.

As shown in FIG. 29, each hanger bracket plate 198 fits downwardly into a separate one of four rectangular notches 199-1, 199-2, 199-3, 199-4, which extend downwardly into upper transverse end wall 159 of antenna mast housing 152 at circumferentially spaced apart intervals of 90 degrees.

As shown in FIGS. 19-25, each base plate 196 has a square outline shape, and is secured to mast housing 152 by a pair of circumferentially spaced apart screws 200, 201 which are inserted through holes 202, 203 located next to outer longitudinal edges 204, 205 of the base plate, and through a pair of aligned holes 206, 207 through mast housing 152 into bore 157 of the mast housing, where nuts 208, 209 are tightened onto the threaded shanks of the screws.

Figure 19:
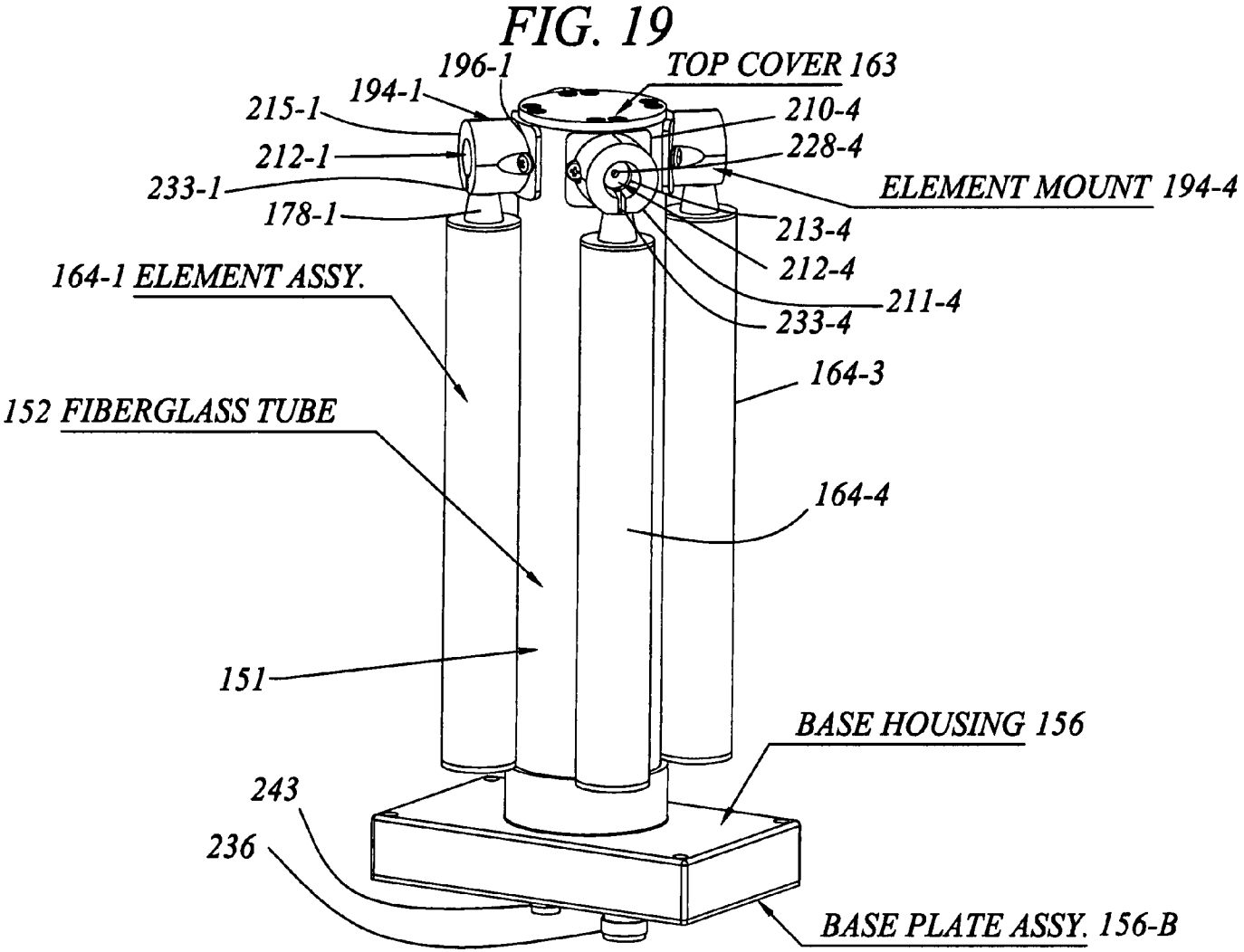
FIG. 19 is a perspective view showing all four elements folded down for storage.

As shown in FIG. 19, each antenna element mount 194 has protruding outwards from outer surface 210 of base plate 196 a circular cross-section cylindrically-shaped boss 211. Each boss 211 has disposed through its length a frusto-conically tapered smooth-wall blind socket bore 212. Socket bore 212 terminates in an inner circular disk-shaped end wall 213, which is disposed transversely to the longitudinal axis of the bore, and parallel to longitudinal axis of antenna mast 152. Also, socket bore 212 of antenna element mount 194 is of the proper size and shape to receive in an interference fit the support peg 178 of an antenna element 168. According to the invention, each element 168 of the foldable antenna 150 includes a tensioning mechanism to maintain a radially inwardly directed force on a support peg 178 inserted into a socket bore 212 to retain the peg in a the socket bore, as will now be described.

A may be seen best by referring to FIGS. 21-25, a tension mechanism 215 for releasably exerting a radially inwardly directed force on antenna element support peg 178 to thus hold the peg in element mount socket bore 212 and thereby maintain antenna element 164 in a radially disposed orientation relative to antenna mast 152 includes a longitudinally elongated helical tension spring 216 located coaxially within the bore 169 disposed longitudinally through element housing 168. Spring 216 has at one end thereof a longitudinally disposed portion which fits coaxially within the bore 217 of an elongated cylindrically-shaped guide tube 218. Guide tube 218 fits coaxially within a blind coaxial bore 219 which extends longitudinally into the center of an inner transverse end wan 220 of cylindrical body 174 of element adapter 173 located within bore 169 of element housing 168.

Spring 216 is longitudinally movable within bore 217 of guide tube 218, and has abutting an outer transverse end thereof a cylindrically-shaped stop sleeve 221. Stop sleeve 221 has extending longitudinally from the center of the inner transverse face 222 thereof an elongated flexible wire tensioning cable 224. Tensioning cable 224 extends longitudinally inwardly through spring 216 along the center line of the spring, and through a small diameter wire bore 225 which extends longitudinally inwardly through the inner face 226 of guide tube bore 217, and out from the outer transverse end face 227 of antenna element support peg 178.

The inner end portion of tensioning cable 224 extends through a cable bore 228 that extends through the center of the inner transverse end wall 213 of socket bore 212 in the element mount boss 211, and into the bore 157 through the antenna mast housing 152. The inner end of tensioning cable 224 is secured against radially outward movement by an inner stop bushing 229 which is fastened to the inner end of the cable and retained in a cup-shaped blind bore 230 which extends into the inner longitudinally disposed end wall 231 of the element support boss 211.

Figures 20, 22, 23, 24, 25:
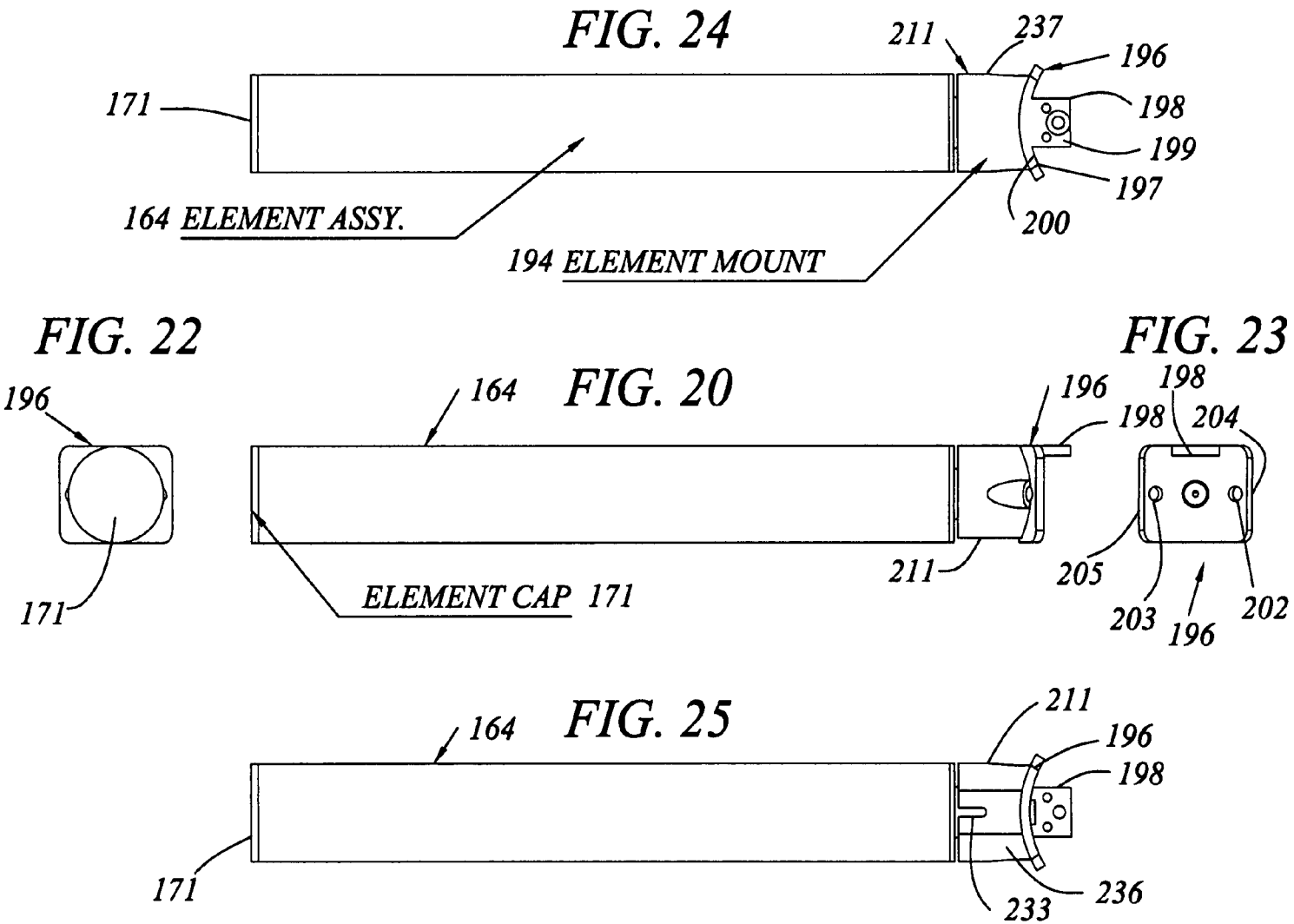
FIG. 20 is a side elevation view of one of the four identical elements of the antenna of FIG. 13.
FIG. 22 is an outer end elevation view of the element of FIG. 20.
FIG. 23 is an inner end elevation view of the element of FIG. 20.
FIG. 24 is an upper plan view of the element of FIG. 20.
FIG. 25 is a lower plan view of the element of FIG. 20.
Figures 26, 27, 28:
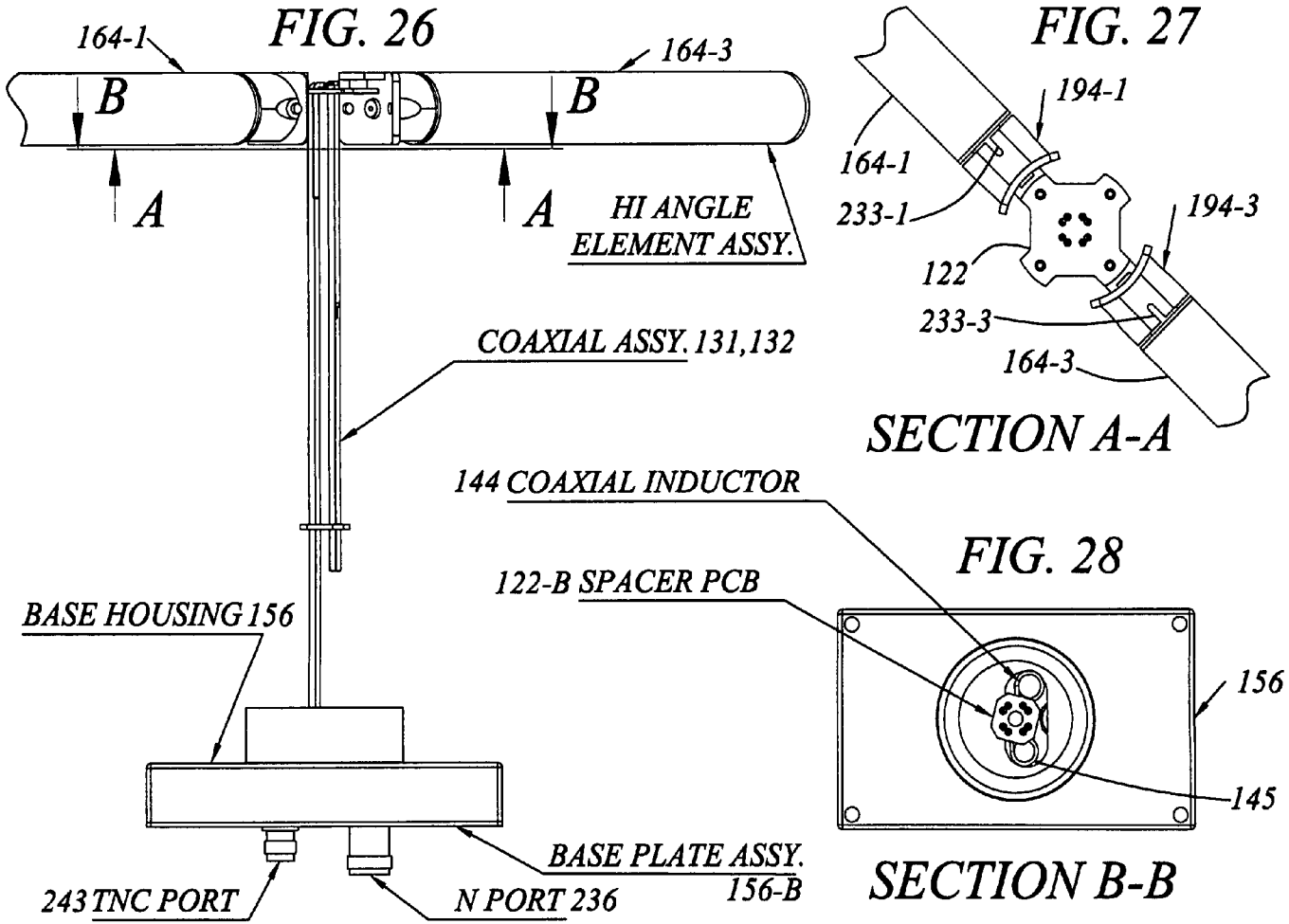
FIG. 26 is a fragmentary view of the antenna of FIG. 15.
FIG. 27 is a annular lower plan view of the structure of FIG. 21.
FIG. 28 is a transverse sectional view of the antenna structure of FIG. 26, taken in the direction 28-28.

As shown in FIGS. 19, 25 and 27, each foldable antenna element support boss 211 has cut into the lower side of the outer longitudinally disposed annular wall 232 thereof a vertically disposed, rectangularly-shaped slot 233 which penetrates the inner cylindrical wall surface 234 of the socket bore 212 in the boss and extends downwardly through a flat 235 formed in the lower side 236 of the outer cylindrical wall surface 237 of the boss, and radially inwardly about half the radial length of the boss.

Figure 15:
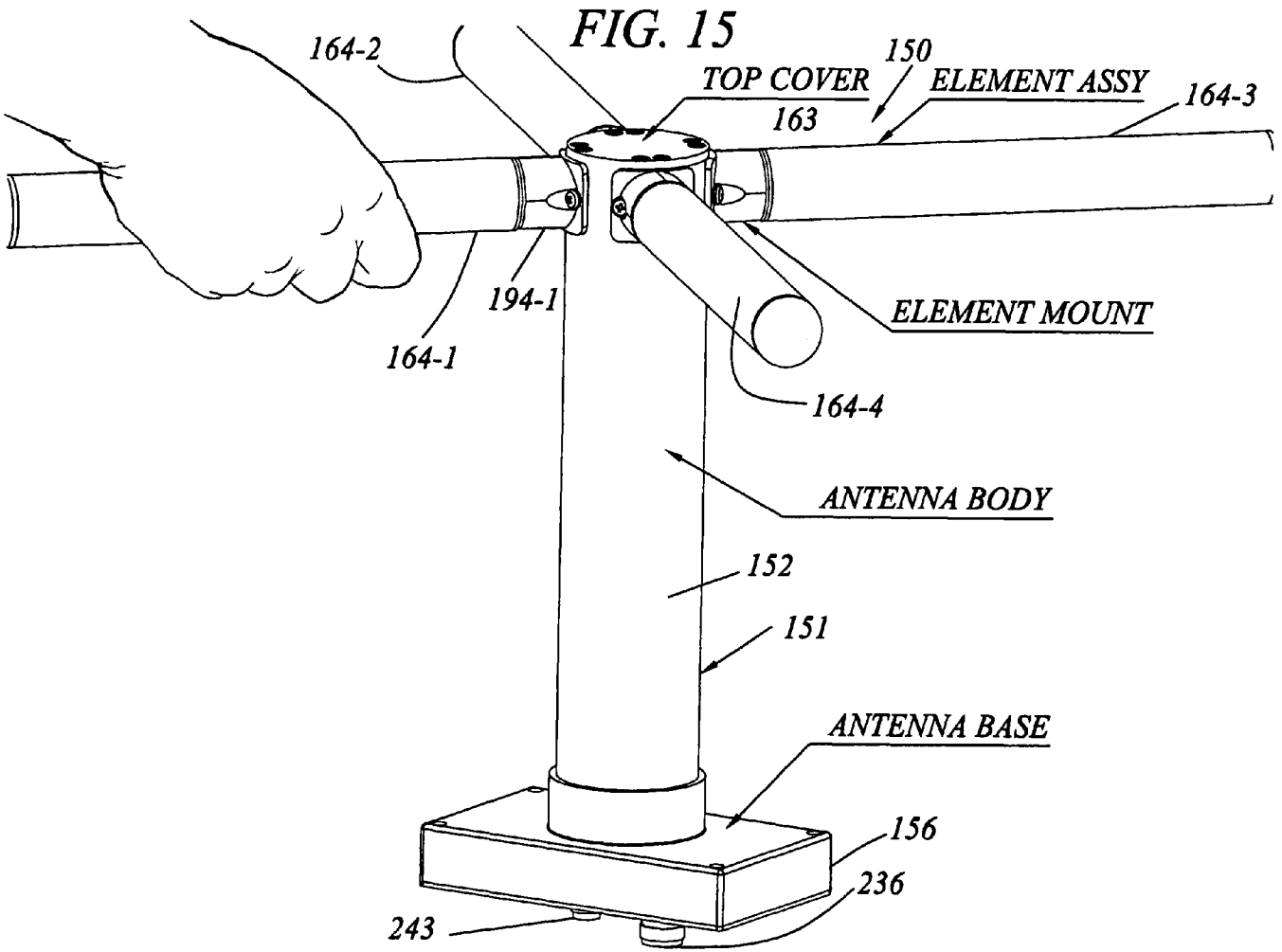
FIG. 15 is a perspective view of the antenna of FIG. 13, showing a first step in re-configuring one of four elements from an operational use position, to a compact storage and shipment configuration, and showing a fourth and final step in re-configuring the element from a stowed configuration to a use configuration.

With the foregoing construction, elements 164 of foldable element antenna 150 may be re-configured from an operational use position as shown in FIGS. 13 and 15, in which each element support peg 178 is secured with the socket bore 212 of an antenna element mount boss 211 by tension spring 216 within the element, to a compact, folded configuration as shown in 19.

Figure 16:
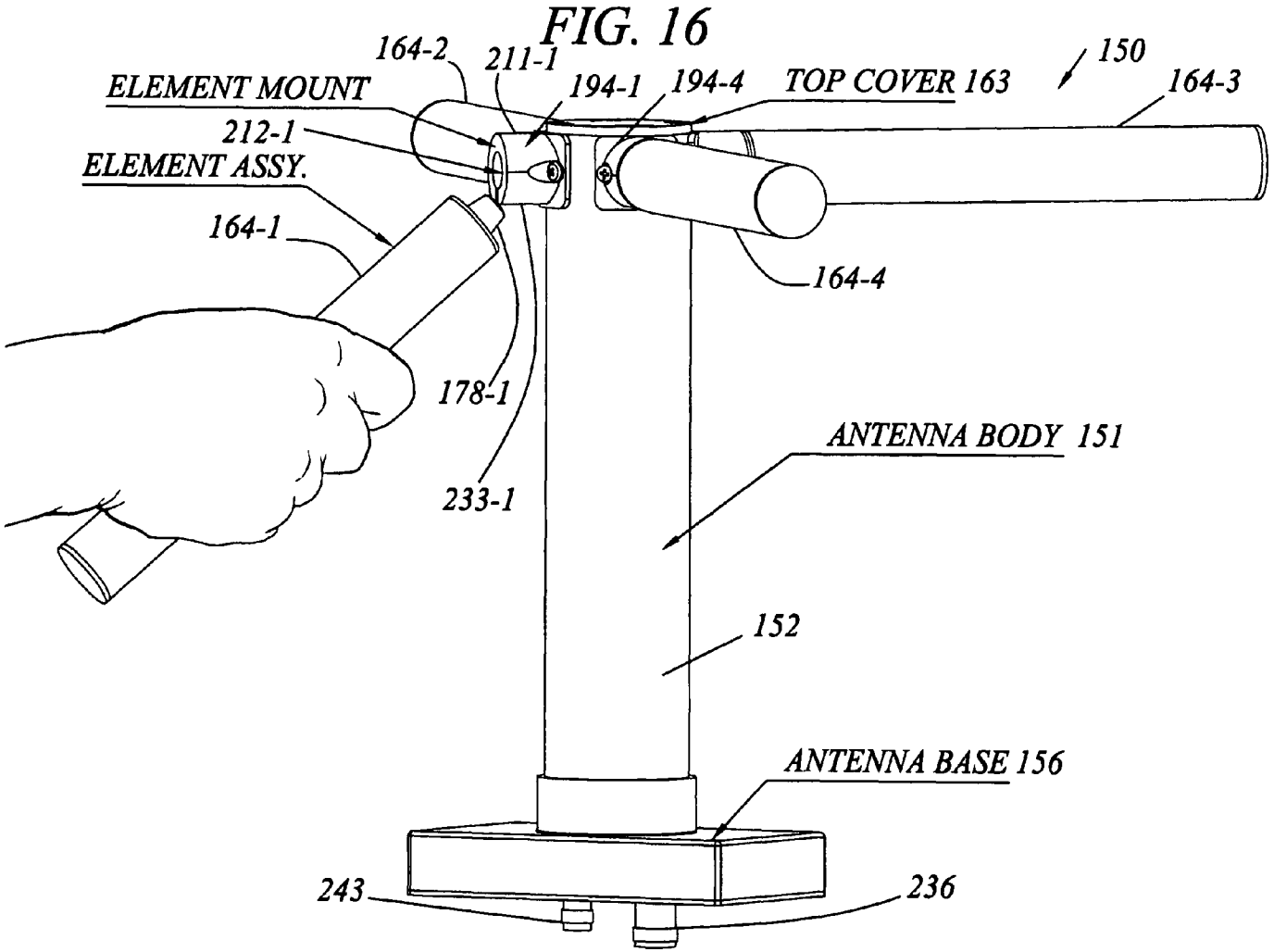
FIG. 16 is a view similar to that of FIG. 15, showing a second step in folding the element down and a third step in folding the element up.
Figure 18:
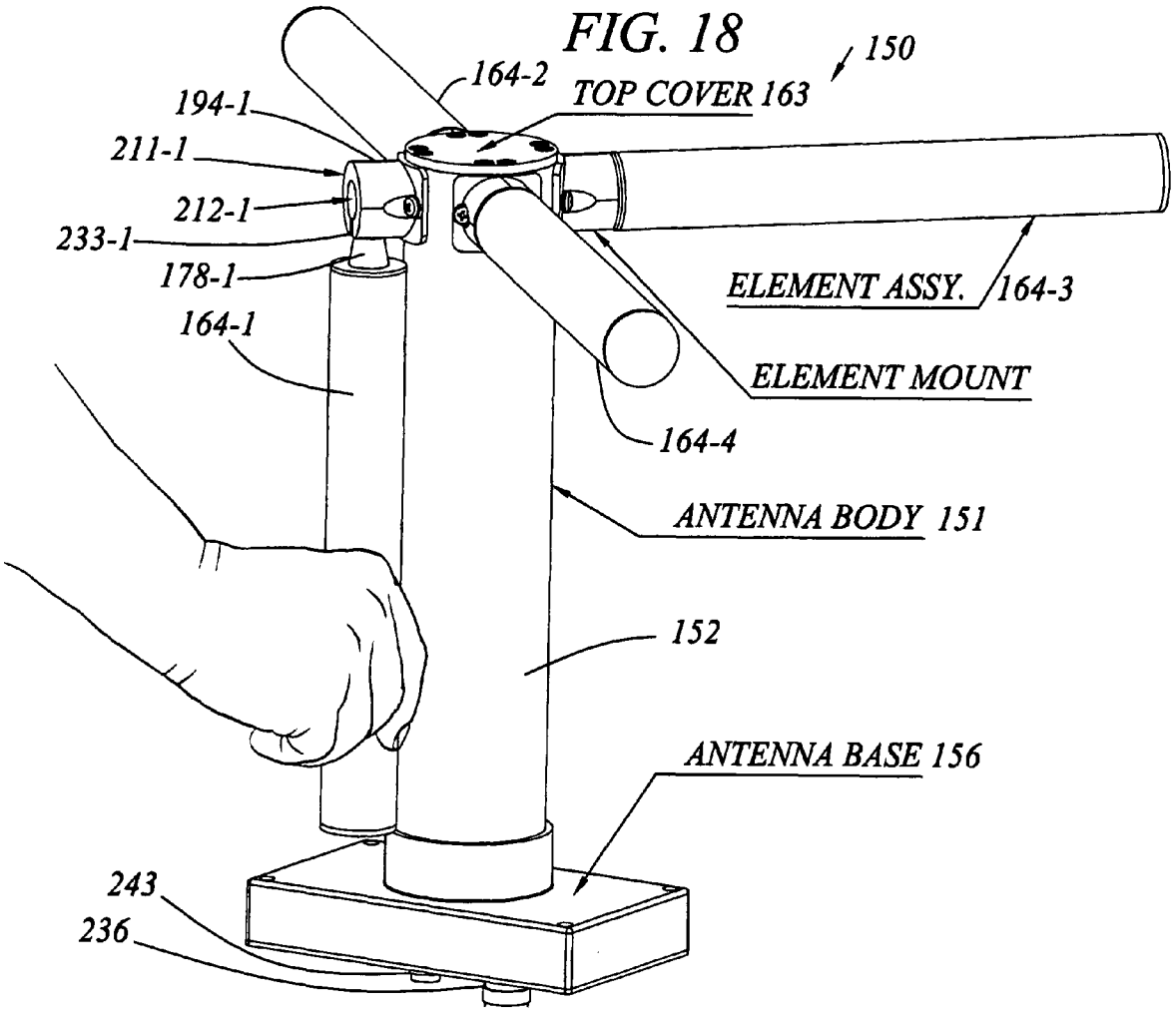
FIG. 18 is a view similar to that of FIG. 17, showing a fourth and final step in folding the element down, and a first step in folding the element up.

As shown in FIGS. 16-18, re-configuration of antenna 150 from an operational to a folded configuration is accomplished by first grasping in turn each element 164 and pulling the element radially outwards from element mount 194 against tension afforded by spring 216, sufficiently far for the element support peg 178 protruding from the inner end of the element to be withdrawn from the socket bore 212 in the antenna element mount boss 216. Thus freed, the element 164 may be folded downwardly towards parallel alignment with antenna mast housing 152, with the tensioning cable 224 sliding into the slot 233 in the lower wall 232 of the element mount boss 211. When pulling force exerted on the element 164 is then released, tension in spring 216 draws the flat outer face 227 of element support peg 178 into compressive contact with the flat 235 in the lower surface of antenna element mount boss 211, thus retaining the element in a downwardly oriented, folded position.

Re-configuration of antenna 150 from a folded configuration to an operational configuration is accomplished as shown in the sequence of FIGS. 19, 18 17, 16 and 15. As shown in that sequence of figures, re-configuration to an operational configuration is accomplished by in turn grasping each individual antenna element 164 and pulling the element downwards against tension of spring 216 sufficiently far to unseat the flat end face 227 of antenna element support peg 178 from the flat 235 at the bottom of an antenna element support boss 211. The element 168 is then orbited upwardly in an arc until the antenna element support peg 178 is longitudinally aligned with an element mount socket bore 212. Pulling tension in the element 164 is then released, thus enabling tension in element spring 216 to pull element support peg 178 into element mount socket bore 212 and thus secure the element in a radially outwardly disposed operational orientation.

Other than differences in antenna elements 164 and mounts 194 described above, the structure and functions of foldable element modification 150 of replaceable element antenna 50 described previously and antenna 50 are identical. Thus, as shown in FIGS. 6 and 9, foldable element antenna 150 preferably also includes the construction shown in FIG. 6 to enable the foldable element antenna to function in a linearly polarized mode as well as a circularly polarized mode.

What is claimed is:

1. A radio antenna comprising;

a. an elongated mast, b. at least a first electrically conductive element which is disposed radially to the longitudinal axis of said mast, c. a first mechanical coupling mechanism which enables said first electrically conductive element to be alternately disposed perpendicularly to said mast for transmitting and receiving radio signals, and disposed substantially parallel to said mast to minimize the envelope size of said antenna, d. a second element disposed radially from said longitudinal axis of said mast at a location spaced circumferentially apart from said first element, said second element being diametrically opposed to said first element thus forming with said first element a pair of elements of a first linear electric dipole which are co-planar in a first plane containing the longitudinal axis of said mast, e. a second mechanical coupling mechanism which enables said second electrical element to be alternatively disposed perpendicularly to said mast and disposed substantially parallel to said mast, said first and second mechanical coupling mechanisms each including a releasable fastener mechanism which enables said first and second elements to be attached to said mast in a radially disposed orientation to enable said antenna elements to transmit and receive radio signals and re-attachably removed from said mast to enable said antenna elements to be positioned substantially parallel to said mast, said releasable fastener mechanism including in combination an externally threaded stud protruding from one of said element and said mast, and an internally threaded socket attached to the other of said mast and element, said socket being capable of threadingly receiving said stud.

2. A radio antenna comprising;

a. an elongated tubular mast, b. at least a first electrically conductive element mount attached to said mast near the upper end of said mast, c. a first radio wave conducting guide connected at a distal end thereof to said first conductive element mount and disposed downwardly through said mast, d. at least a first electrically conductive element, e. a first mechanical coupling mechanism which enables said first electrically conductive element to be alternately connected to said first element mount disposed radially outwardly from said mast for transmitting and receiving radio signals, and disposed substantially parallel to said mast to minimize the envelope size of said antenna, f. a second electrically conductive element mount attached to said mast near the upper end thereof at a location spaced circumferentially apart 180 degrees from said first element mount, g. a second electrically conductive element, h. a second mechanical coupling mechanism which enables said second electrically conductive element to be alternately connected to said second element mount disposed radially outwardly from said mast for transmitting and receiving radio signals and disposed substantially parallel to said mast to minimize the envelope space of said antenna, i. electrical circuitry for connecting said second electrically conductive element mount to an electrical node shifted in phase by 180 degrees from said connection of said first radio wave conducting guide connected to said first element mount, j. said first and second mechanical coupling mechanisms each including a releasable fastener mechanism which enables said first and second elements to be attached to said mast in a radially disposed orientation to enable said antenna elements to transmit and receive radio signals and re-attachably removed from said mast to enable said antenna elements to be positioned substantially parallel to said mast, and k. said releasable fastener mechanism including in combination an externally threaded stud protruding from one of said element and said mast, and an internally threaded socket attached to the other of said mast and element. said socket being capable of threadingly receiving said stud.

3. The antenna of claim 2 wherein said first and second mechanical coupling mechanisms are further defined as including a foldable fastener mechanism which enables said first and second elements to be releasably attached to said mast at locked positions disposed radially to the longitudinal axis of said mast, and unlocked to enable said elements to be folded towards substantially parallel alignment with the longitudinal axis of said mast.

4. A radio antenna comprising;

a. an elongated mast, b. at least a first electrically conductive element which is disposed radially to the longitudinal axis of said mast, c. a first mechanical coupling mechanism which enables said first electrically conductive element to be alternately disposed perpendicularly to said mast for transmitting and receiving radio signals, and disposed substantially parallel to said mast to minimize the envelope size of said antenna, d. a second element disposed radially from said longitudinal axis of said mast at a location spaced circumferentially apart from said first element, said second element being diametrically opposed to said first element thus forming with said first element a pair of elements of a first linear electric dipole which are co-planar in a first plane containing the longitudinal axis of said mast, e. a second mechanical coupling mechanism which enables said second electrical element to be alternatively disposed perpendicularly to said mast and disposed substantially parallel to said mast, said first and second mechanical coupling mechanisms including a foldable fastener mechanism which enables said first and second elements to be releasably attached to said mast at locked positions disposed radially to the longitudinal axis of said mast, and unlocked to enable said elements to be folded towards substantially parallel alignment with the longitudinal axis of said mast, said foldable fastener mechanism including in combination a stud protruding from one of said element and said mast, a socket attached to the other of said mast and element for insertably receiving said stud, and a tensioning mechanism for exerting force on said stud which urges said stud into said socket.

5. The antenna of claim 4 wherein said tensioning mechanism is further defined as including a tether which maintains said stud at a pre-determined maximum distance from said mast when said stud is removed from said socket.

6. The antenna of claim 5 wherein said tensioning mechanism is further defined as including a flexible cord extending between said stud and said socket and a spring mechanism for exerting tension on said cord tending to reduce the length of cord between said stud and said socket.

7. A radio antenna comprising;

a. an elongated tubular mast, b. at least a first electrically conductive element mount attached to said mast near the upper end of said mast, c. a first radio wave conducting guide connected at a distal end thereof to said first conductive element mount and disposed downwardly through said mast, d. at least a first electrically conductive element, e. a first mechanical coupling mechanism which enables said first electrically conductive element to be alternately connected to said first element mount disposed radially outwardly from said mast for transmitting and receiving radio signals, and disposed substantially parallel to said mast to minimize the envelope size of said antenna, f. a second electrically conductive element mount attached to said mast near the upper end thereof at a location spaced circumferentially apart 180 degrees from said first element mount, g. a second electrically conductive element, h. a second mechanical coupling mechanism which enables said second electrically conductive element to be alternately connected to said second element mount disposed radially outwardly from said mast for transmitting and receiving radio signals and disposed substantially parallel to said mast to minimize the envelope space of said antenna, i. electrical circuitry for connecting said second electrically conductive element mount to an electrical node shifted in phase by 180 degrees from said connection of said first radio wave conducting guide connected to said first element mount, said first and second mechanical coupling mechanisms including a foldable fastener mechanism which enables said first and second elements to be releasably attached to said mast at locked positions disposed radially to the longitudinal axis of said mast, and unlocked to enable said elements to be folded towards substantially parallel alignment with the longitudinal axis of said mast, said foldable fastener mechanism including in combination a stud protruding from one of said element and said mast, a socket attached to the other of said mast and element for insertably receiving said stud, and a tensioning mechanism for exerting force on said stud which urges said stud into said socket.

8. The antenna of claim 7 wherein said tensioning mechanism is further defined as including a tether which maintains said stud at a pre-determined maximum distance from said mast when said stud is removed from said socket.

9. The antenna of claim 8 wherein said tensioning mechanism is further defined as including a flexible cord extending between said stud and said socket and a spring mechanism for exerting tension on said cord tending to reduce the length of cord between said stud and said socket.

10. The antenna of claim 9 further including a third electrically conductive antenna element disposed longitudinally within said mast.

* * * * *